US011390078B2

(12) United States Patent
Hamano

(10) Patent No.: US 11,390,078 B2
(45) Date of Patent: Jul. 19, 2022

(54) INKJET HEAD AND INKJET RECORDING APPARATUS

(71) Applicant: Konica Minolta, Inc., Tokyo (JP)

(72) Inventor: Hikaru Hamano, Saitama (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/271,930

(22) PCT Filed: Aug. 29, 2018

(86) PCT No.: PCT/JP2018/031928

§ 371 (c)(1),
(2) Date: Feb. 26, 2021

(87) PCT Pub. No.: WO2020/044457

PCT Pub. Date: Mar. 5, 2020

(65) Prior Publication Data

US 2021/0316552 A1 Oct. 14, 2021

(51) Int. Cl.
*B41J 2/14* (2006.01)
*B41J 2/18* (2006.01)

(52) U.S. Cl.
CPC ..... *B41J 2/14201* (2013.01); *B41J 2/18* (2013.01); *B41J 2002/14225* (2013.01); *B41J 2002/14419* (2013.01); *B41J 2202/12* (2013.01)

(58) Field of Classification Search
CPC ..... B41J 2/14201; B41J 2/18; B41J 2202/21; B41J 2002/14467; B41J 2002/14419;
(Continued)

(56) References Cited

U.S. PATENT DOCUMENTS 10,245,841 B2 * 4/2019 Asaka ..... B41J 2/19
10,457,063 B2 * 10/2019 Matsuo ..... B41J 2/18
(Continued)

FOREIGN PATENT DOCUMENTS

JP 2009056766 A 3/2009
JP 2016010862 A 1/2016
WO 2018008397 A1 1/2018

OTHER PUBLICATIONS

International Preliminary Report on Patentability and Written Opinion of the International Searching Authority for International Application No. PCT/JP2018/031928; dated Mar. 2, 2021.
(Continued)

*Primary Examiner* — An H Do
(74) *Attorney, Agent, or Firm* — Cantor Colburn LLP

(57) ABSTRACT

Provided is an inkjet head including a plurality of ink dischargers, a first common ejection flow path, and a second common ejection flow path. Each of the ink dischargers includes an ink storage, a pressure changer, a nozzle, and a first individual ejection flow path and a second individual ejection flow path that communicate to the ink storage and through which ink is ejected from fee ink storage but not supplied to the nozzle. The first common ejection flow path communicates to a plurality of first individual ejection flow paths of the respective plurality of the ink dischargers, and the second common ejection flow path communicates to a plurality of second individual ejection flow paths of the respective plurality of fee ink dischargers. A shape of a first section of first common ejection flow path into which ink flows from the plurality of first individual ejection flow paths is different from a shape of a second section of the second common ejection flow path into which ink flows from the plurality of second individual election flow paths.

11 Claims, 13 Drawing Sheets

(58) Field of Classification Search
CPC ..... B41J 2002/14225; B41J 2202/11; B41J 2202/12; B41J 2202/20
See application file for complete search history.

(56) References Cited

U.S. PATENT DOCUMENTS

| | | | | |
|---|---|---|---|---|
| 10,836,164 | B2 * | 11/2020 | Kuramochi | B41J 2/19 |
| 10,870,274 | B2 * | 12/2020 | Tsukahara | B41J 2/175 |
| 2014/0036001 | A1 | 2/2014 | Hoisington et al. | |
| 2015/0124019 | A1 | 5/2015 | Cruz-Uribe et al. | |

OTHER PUBLICATIONS

International Search Report for International Application No. PCT/JP2018/031928, dated Oct. 23, 2018.
EPO Extended Search Report for corresponding EP Application No. 18931609.4; dated Aug. 10, 2021.

* cited by examiner

FIG. 12

| No. | FIRST SECTION S1 IN FIRST COMMON EJECTION FLOW PATH 142a | | | | SECOND SECTION S2 IN SECOND COMMON EJECTION FLOW PATH 142b | | | | SIZE RATIO | | | | CROSSTALK EVALUATION RESULTS |
|---|---|---|---|---|---|---|---|---|---|---|---|---|---|
| | LENGTH La | WIDTH Wa | DEPTH Da | VOLUME Va | LENGTH Lb | WIDTH Wb | DEPTH Db | VOLUME Vb | LENGTH (Lb/La) | WIDTH (Wb/Wa) | DEPTH (Db/Da) | VOLUME (Vb/Va) | |
| | [mm] | [mm] | [mm] | [$mm^3$] | [mm] | [mm] | [mm] | [$mm^3$] | | | | | |
| 1 | 72 | 1 | 1 | 72 | 72 | 1 | 1 | 72.0 | 72 | 1 | 1 | 1.00 | POOR |
| 2 | 72 | 1 | 1 | 72 | 72 | 1 | 1.05 | 75.6 | 72 | 1 | 1.05 | 1.05 | POOR |
| 3 | 72 | 1 | 1 | 72 | 72 | 1 | 1.1 | 79.2 | 72 | 1 | 1.1 | 1.10 | GOOD |
| 4 | 72 | 1 | 1 | 72 | 72 | 1 | 1.2 | 86.4 | 72 | 1 | 1.2 | 1.20 | GOOD |
| 5 | 72 | 1 | 1 | 72 | 72 | 1 | 1.3 | 93.6 | 72 | 1 | 1.3 | 1.30 | GOOD |
| 6 | 72 | 1 | 1 | 72 | 72 | 1 | 1.4 | 100.8 | 72 | 1 | 1.4 | 1.40 | GOOD |
| 7 | 72 | 1 | 1 | 72 | 72 | 1 | 1.5 | 108.0 | 72 | 1 | 1.5 | 1.50 | GOOD |
| 8 | 72 | 1 | 1 | 72 | 72 | 1.05 | 1 | 75.6 | 72 | 1.05 | 1 | 1.05 | POOR |
| 9 | 72 | 1 | 1 | 72 | 72 | 1.1 | 1 | 79.2 | 72 | 1.1 | 1 | 1.10 | GOOD |
| 10 | 72 | 1 | 1 | 72 | 72 | 1.2 | 1 | 86.4 | 72 | 1.2 | 1 | 1.20 | GOOD |
| 11 | 72 | 1 | 1 | 72 | 72 | 1.3 | 1 | 93.6 | 72 | 1.3 | 1 | 1.30 | GOOD |
| 12 | 72 | 1 | 1 | 72 | 72 | 1.4 | 1 | 100.8 | 72 | 1.4 | 1 | 1.40 | GOOD |
| 13 | 72 | 1 | 1 | 72 | 72 | 1.5 | 1 | 108.0 | 72 | 1.5 | 1 | 1.50 | GOOD |
| 14 | 72 | 1 | 1 | 72 | 72 | 1.05 | 1.05 | 79.4 | 72 | 1.05 | 1.05 | 1.10 | GOOD |
| 15 | 72 | 1 | 1 | 72 | 72 | 1.1 | 1.1 | 87.1 | 72 | 1.1 | 1.1 | 1.21 | GOOD |
| 16 | 72 | 1 | 1 | 72 | 72 | 1.2 | 1.2 | 103.7 | 72 | 1.2 | 1.2 | 1.44 | GOOD |
| 17 | 72 | 1 | 1 | 72 | 72 | 1.3 | 1.3 | 121.7 | 72 | 1.3 | 1.3 | 1.69 | GOOD |
| 18 | 72 | 1 | 1 | 72 | 72 | 1.4 | 1.4 | 141.1 | 72 | 1.4 | 1.4 | 1.96 | GOOD |
| 19 | 72 | 1 | 1 | 72 | 72 | 1.5 | 1.5 | 162.0 | 72 | 1.5 | 1.5 | 2.25 | GOOD |

INKJET HEAD AND INKJET RECORDING APPARATUS

CROSS REFERENCE TO RELATED APPLICATIONS

The present invention claims priority under 35 U.S.C. § 119 to International Patent Application No. PCT/JP2018/031928, filed on Aug. 29, 2018, the entire contents of which are incorporated herein by reference.

TECHNOLOGICAL FIELD

The present invention relates to an inkjet head and an inkjet recording apparatus.

BACKGROUND ART

There is known an inkjet recording apparatus which forms an image with ink discharged from nozzles on inkjet heads and landed on desired positions. An inkjet head of an inkjet recording apparatus includes ink storages for storing ink and pressure changers for changing pressure in ink in the ink storages corresponding to nozzles, and discharges ink from the nozzles communicating to the ink storages according to change in the pressure in ink in the ink storages.

In an inkjet head, as air bubbles and foreign substances enter the ink storage, pressure is not normally applied to ink, and an error occurs in ink discharge from the nozzle, degrading image quality. Therefore, conventionally, there is a technique in which multiple ink storages respectively corresponding to nozzles communicate to a common ejection flow path and part of ink supplied to each ink storage is ejected outside an inkjet head via the common ejection flow path with air bubbles and foreign substances. There is also a technique in which ink is ejected from ink storages to two common ejection flow paths to make it easier to eject air bubbles and foreign substances (for example, Patent Document 1).

CITATION LIST

Patent Literature

Patent Document 1: Japanese Patent Application Laid-Open Publication No. 2009-056766A

SUMMARY OF INVENTION

Technical Problem

However, in an inkjet head with a common ejection flow path, a pressure wave with characteristics corresponding to the shape of the common ejection flow path is generated as a standing wave in the common ejection flow path, caused by changes in pressure in ink in ink storages. A pressure wave generated in the ink storage by the standing wave further causes pressure in ink in the ink storage to deviate from the desirable pressure in ink discharge, and the characteristics of ink discharge from the nozzles to fluctuate, leading to deterioration of the quality of the recorded image. Especially in a configuration with two common ejection flow paths as in the above conventional technique, the image quality significantly deteriorates, problematically, as pressure waves caused by standing waves generated in the common ejection flow paths are superposed.

An object of the present invention is to provide an inkjet head and an inkjet recording apparatus that effectively suppress deterioration of image quality.

Solution to Problem

To achieve at least one of the above-mentioned objects, the invention recited in claim 1 is an inkjet head including:

a plurality of ink dischargers, each including:

an ink storage for storing ink;

a pressure changer that changes pressure in ink stored in the ink storage;

a nozzle which communicates to the ink storage and through which ink is discharged according to change in the pressure in ink in the ink storage; and a first individual ejection flow path and a second individual ejection flow path which communicate to the ink storage and through which ink is ejected from the ink storage but not supplied to the nozzle;

a first common ejection flow path that communicates to a plurality of first individual ejection flow paths of the respective plurality of the ink dischargers; and a second common ejection flow path that communicates to a plurality of second individual ejection flow paths of the respective plurality of the ink dischargers;

wherein a shape of a first section of the first common ejection flow path into which ink flows from the plurality of first individual ejection flow paths is different from a shape of a second section of the second common ejection flow path into which ink flows from the plurality of second individual ejection flow paths.

The invention recited in claim 2 is the inkjet head according to claim 1, wherein a volume of the first section of the first common ejection flow path is different from a volume of the second section of the second common ejection flow path.

The invention recited in claim 3 is the inkjet head according to claim 2, wherein the volume of the second section of the second common ejection flow path is 1.1 times or more the volume of the first section of the first common ejection flow path.

The invention recited in claim 4 is the inkjet head according to claim 3, wherein in the first section of the first common ejection flow path, a cross section perpendicular to a direction of ink ejection has a rectangular shape with a first area throughout in the direction of ink ejection;

wherein in the second section of the second common ejection flow path, a cross section perpendicular to a direction of ink ejection is a rectangular shape with a second area throughout in the direction of ink ejection; and wherein the second area is 1.1 times or more the first area.

The invention recited in claim 5 is the inkjet head according to any one of claims 2 to 4, wherein the volume of the second section of the second common ejection flow path is 10 times or less the volume of the first section of the first common ejection flow path.

The invention recited in claim 6 is the inkjet head according to any one of claims 1 to 5, wherein a length of the first section in a direction of ink ejection in the first section is different from a length of the second section in a direction of ink ejection in the second section.

The invention recited in claim 7 is the inkjet head according to any one of claims 1 to 6, wherein a surface roughness of an inner wall of the first section of the first common ejection flow path is different from a surface roughness of an inner wall of the second section of the second common ejection flow path.

The invention recited in claim 8 is the inkjet head according to any one of claims 1 to 7, wherein a length of the first individual ejection flow path communicating to the ink storage in a direction of ink ejection in the first individual ejection flow path is different from a length of the second individual ejection flow path communicating to the ink storage in a direction of ink ejection in the second individual ejection flow path.

The invention recited in claim 9 is the inkjet head according to any one of claims 1 to 8, wherein the first individual ejection flow path communicating to the ink storage includes two or more first individual ejection flow paths, and the second individual ejection flow path communicating to the ink storage includes two or more second individual flow paths.

The invention recited in claim 10 is the inkjet head according to any one of claims 1 to 9, including:

an ink ejection opening through which ink is ejected outside, wherein the first common ejection flow path and the second common ejection flow path communicate to the ink ejection opening.

The invention recited in claim 11 is an inkjet recording apparatus including the inkjet head according to any one of claims 1 to 10.

Advantageous Effects of Invention

With the present invention, it is possible to effectively suppress deterioration of image quality.

BRIEF DESCRIPTION OF DRAWINGS

FIG. 12 shows shapes of samples used in an experiment and evaluation results.

DESCRIPTION OF EMBODIMENTS

Hereinafter, an inkjet head and an inkjet recording apparatus according to an embodiment are described with reference to the drawings.

Figure 1:
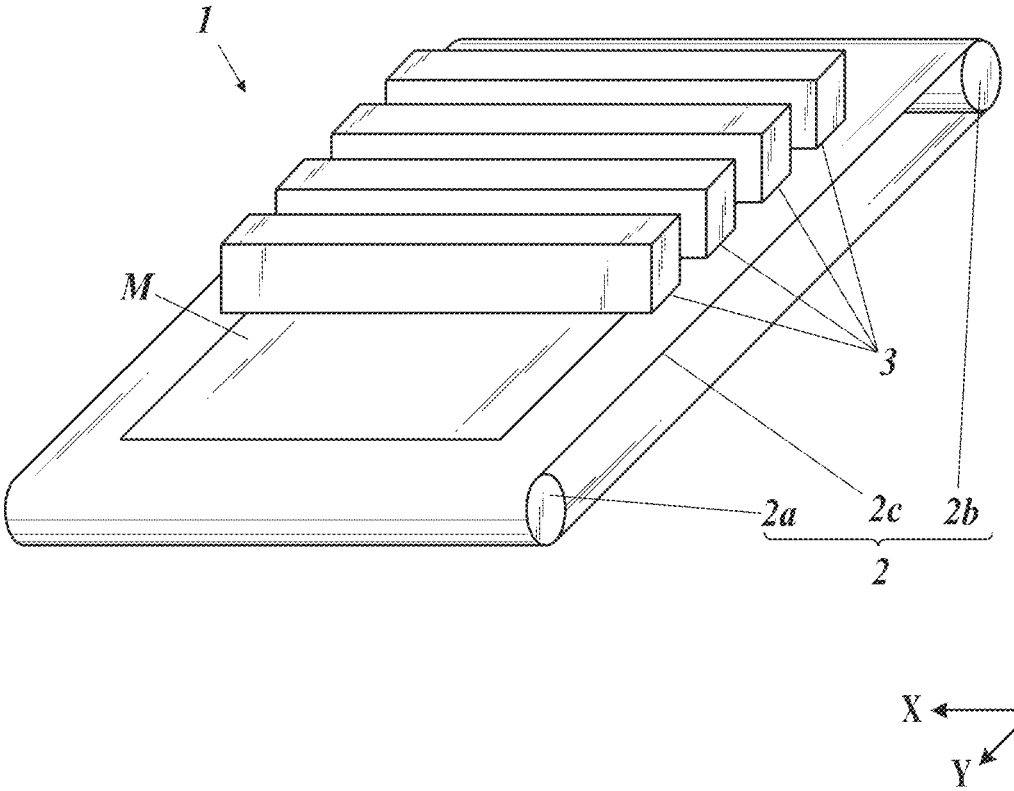
FIG. 1 shows a schematic configuration of an inkjet recording apparatus according to an embodiment of the present invention.

FIG. 1 shows a schematic configuration of an inkjet recording apparatus 1 according to the embodiment of the present invention.

The inkjet recording apparatus 1 includes a conveyor 2, head units 3.

The conveyor 2 includes a conveyance belt 2*c* which is supported inside by two conveying rollers 2*a*, 2*b* rotating around a rotation axis extending in the X direction in FIG. 1. The conveyance belt 2*c*, with the recording medium M being placed on a conveyance surface of the conveyance belt 2*c*, circularly moves according to the rotation of the conveying roller 2*a* with the motion of the conveyance motor, and thereby the conveyor 2 conveys a recording medium M in a moving direction of the conveyance belt 2*c* (conveyance direction; Y direction in FIG. 1).

The recording medium M may be a sheet of paper cut in a certain size. The recording medium M is supplied onto the conveyance belt 2*c* by a sheet feeding device not shown in the drawings, and discharged to a predetermined sheet ejector from the conveyance belt 2*c* after an image is recorded thereon by discharge of ink from the head unit 3. The recording medium M may be roll paper. The recording medium M may be, besides paper such as plain paper and coated paper, various media on which ink landed on the surface may be fixed, such as fabric and sheet-shaped resin.

The head unit 3 discharges ink onto the recording medium M conveyed by the conveyor 2 at predetermined timings according to image data, thereby recording an image. In the inkjet recording apparatus 1 in this embodiment, four head units corresponding respectively to four color ink of yellow (Y), magenta (M), cyan (C), and black (K), are aligned at predetermined intervals in the order of Y, M, C, K from the upstream in the conveyance direction of the recording medium M. The number of the head units 3 may be three or less or five or more.

Figure 2:
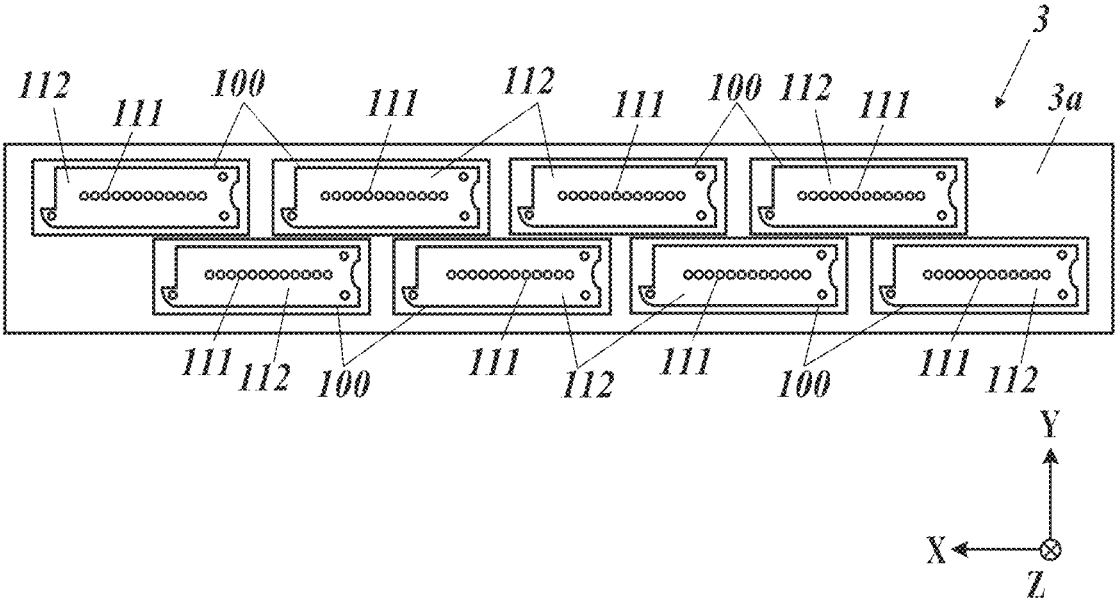
FIG. 2 is a schematic drawing of a configuration of a head unit.

FIG. 2 is a schematic drawing of a configuration of the head unit 3, showing a plan view of the head unit 3 viewed from the side opposite to the conveyance face of the conveyance belt 2*c*. The head unit 3 includes a plate-like base and multiple (eight, in this embodiment) inkjet heads 100 fixed to the base 3*a* by mating with a through hole provided on the base 3*a*. Each of the inkjet heads 100 is fixed to the base 3*a* with the nozzle opening face 112, on which openings of nozzles 111 are disposed, being exposed in the −Z direction from the through hole of the base 3*a*.

In the inkjet head 100, multiple nozzles 111 are aligned at equal intervals in a direction crossing to the conveyance direction of the recording medium (width direction orthogonal to the conveyance direction, that is, X direction in this embodiment). That is, each of the inkjet heads 100 includes a row of nozzles 111 (nozzle row) arranged one-dimensionally at equal intervals in the X direction.

The inkjet head 100 may include multiple nozzle rows. In that case, multiple nozzle rows are arranged alternately in the X direction so that the positions of the nozzles 111 in the X direction do not overlap each other.

The eight inkjet heads 100 of the head unit 3 are arranged in a staggered pattern such that the arrangement range of the nozzles 111 in the X direction is continuous. The arrangement range of the nozzles 111 included in the head unit 3 in the X direction covers the width in the X direction of the area in which an image can be recorded on the recording medium M conveyed by the conveyance belt 2*c*. The head unit 3, which is employed at a fixed position in image recording, discharges ink from the nozzles 111 to the positions at predetermined intervals in the conveyance direction of the recording medium M (conveyance direction intervals), thereby recording an image by a single-pass method.

Figure 3:
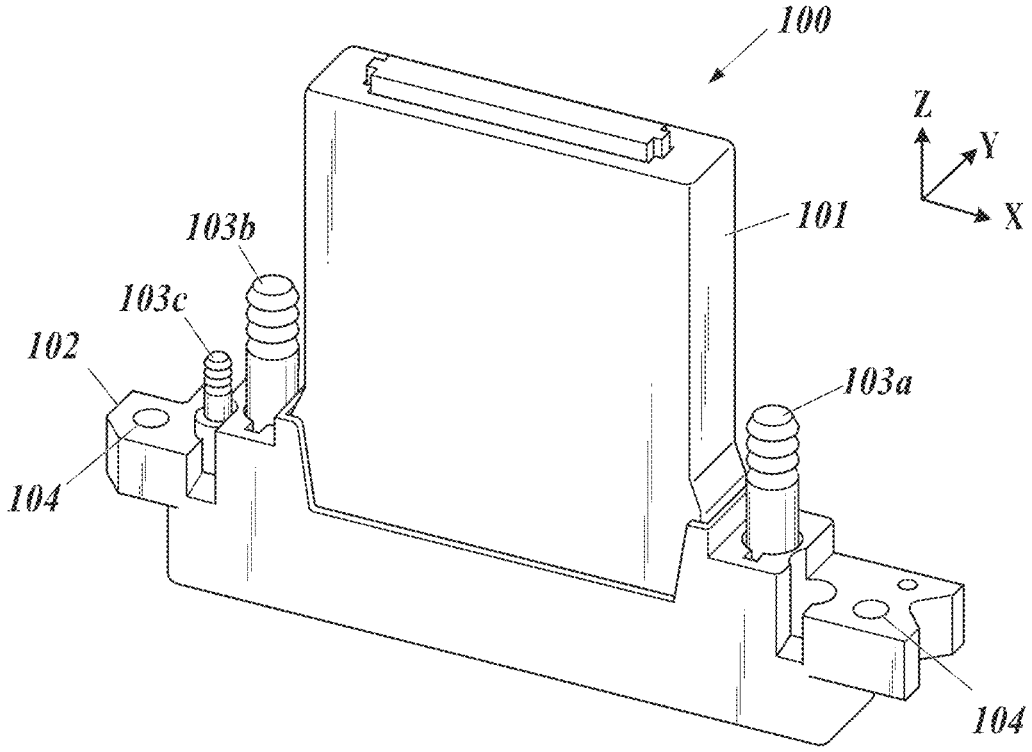
FIG. 3 shows a perspective view of an inkjet head.

FIG. 3 shows a perspective view of the inkjet head 100.

The inkjet head 100, which includes a case 101, and an exterior member 102 mating with the case 101 at the lower end of the case 101, houses main components inside the case 101 and the exterior member 102. The exterior member 102 includes an inlet 103*a* through which ink is supplied from the outside, and outlets 103*b*, 103*c* (ink ejection outlets) through which ink is ejected to the outside. The exterior member 102 includes multiple attachment holes 104 for attaching the inkjet head 100 to the base 3*a* of the head unit 3.

Figure 4:
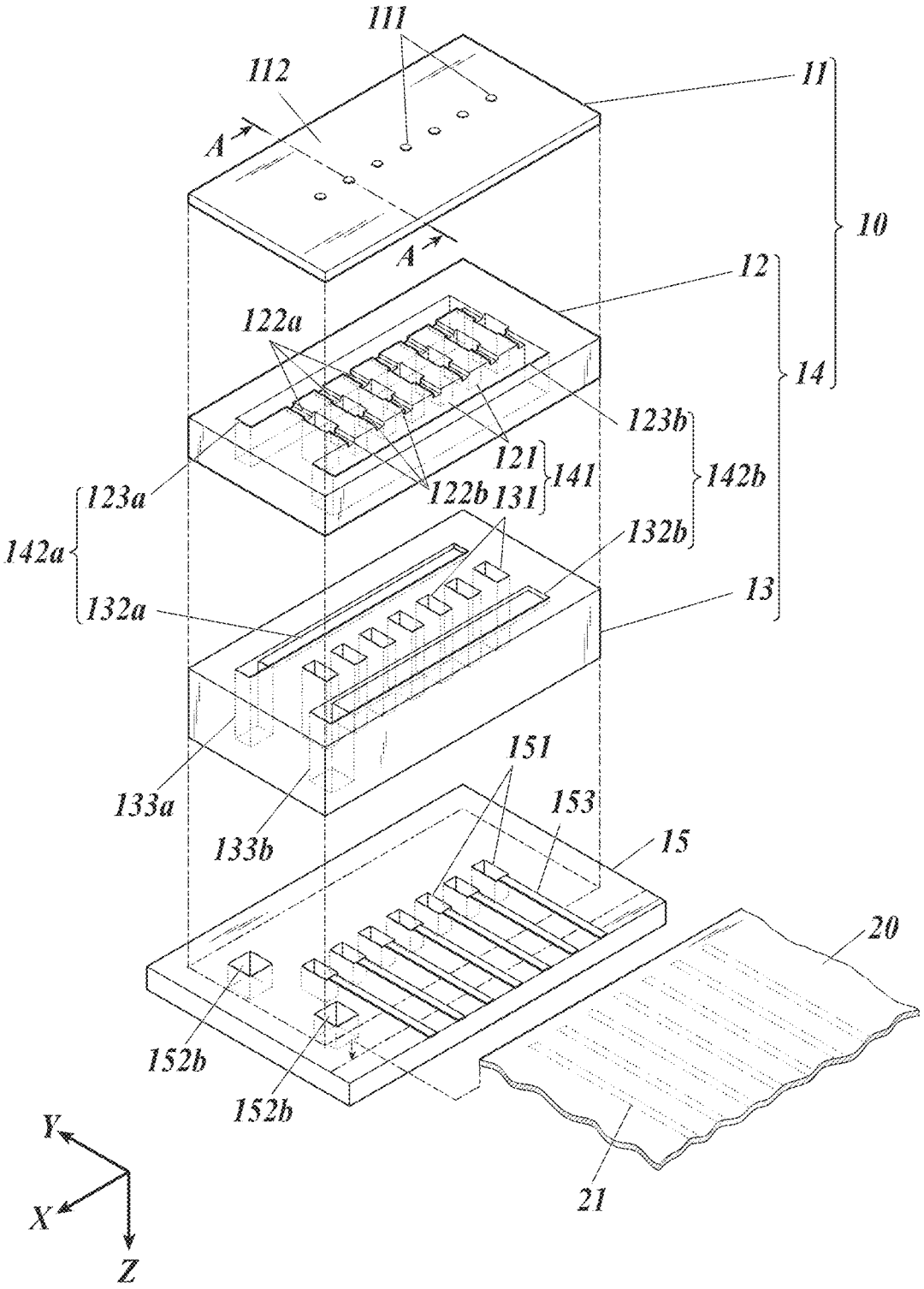
FIG. 4 shows an exploded perspective view of main components of the inkjet head.

FIG. 4 shows an exploded perspective view of the main components of the inkjet head 100.

In FIG. 4, the main components housed inside the exterior member 102 among the components of the inkjet head 100. Specifically, shown in FIG. 4 are a head chip 10 including a nozzle substrate 11, a flow path spacer substrate 12, and a pressure chamber substrate 13, a wiring substrate 15 fixed to the head chip 10, and an FPC 20 (Flexible Printed Circuit) electrically connected to the wiring substrate 15.

In FIG. 4, the components are shown such that the nozzle opening face 112 of the inkjet head 100 is upward, that is, upside down in comparison to FIG. 3. Hereinafter, the −Z direction side of each substrate is referred to as the upper side, and the +Z direction side as the lower side.

The head chip 10 includes a layered structure of the nozzle substrate 11 with the nozzles 111, the flow path spacer substrate 12 with the through flow paths 121 communicating to the nozzles 111, etc., and the pressure chamber substrate 13 with the pressure chambers 131 communicating to the nozzles 111 through the penetrating flow paths 121. Hereinafter, a substrate composed of the flow path spacer substrate 12 and the pressure chamber substrate 13 is referred to as a flow path substrate 14.

The nozzle substrate 11, the flow path spacer substrate 12, the pressure chamber substrate 13, and the wiring substrate 15 are each a plate-like member in a rectangular parallelepiped pillar longer in the X direction.

The nozzle substrate 11 is a substrate of polyimide on which the nozzles 111, the holes penetrating the nozzle substrate 11 in the thickness direction (Z direction) are aligned in the X direction to form a row. The upper surface of the nozzle substrate 11 is the nozzle opening face 112 of the inkjet head 100. The thickness of the nozzle substrate 11 (the length of the nozzles 111 in the ink discharge direction) is, for example, several tens of μm to several hundreds of μm.

The inner wall of each of the nozzles 111 may be in a tapered shape whose cross sectional area perpendicular to the Z direction is smaller toward the opening on the ink discharge side. A substrate of resin other than polyimide, a silicon substrate, a metal substrate such as SUS, etc. may be used as the nozzle substrate 11.

A water-repellent film containing liquid-repellent substance such as fluororesin particles is formed on the nozzle opening face 112 of the nozzle substrate 11, With the water-repellent film, it is possible to suppress adhesion of ink or foreign substances onto the nozzle opening face 112, suppressing occurrence of ink discharge failures due to the adhesion of ink or foreign materials.

The flow path spacer substrate 12 includes the penetrating flow paths 121 communicating to the nozzles 111, the first individual ejection flow paths 122*a* and the second individual ejection flow paths 122*b* branching from the penetrating flow paths 121, and the first belt-like penetrating flow path 123*a* communicating to the first individual ejection flow paths 122*a*, and the first belt-like penetrating flow path 123*b* communicating to the second individual ejection flow paths 122*b*. The penetrating flow paths 121, the first individual ejection flow paths 122*a*, and the second individual ejection flow paths 122*b* among the above are disposed corresponding to the nozzles 111.

The pressure chamber substrate 13 includes the pressure chambers 131 communicating to the penetrating flow paths 121, the first ditch-like flow path 132*a* communicating to the first belt-like penetrating flow path 123*a*, the first vertical ejection flow path 133*a* communicating to the first ditch-like flow path 132*a*, the second ditch-like flow path 132*b* communicating to the second belt-like penetrating flow path 123*b*, and the second vertical ejection flow path 133*b* communicating to the second ditch-like flow path 132*b*. The pressure chambers 131 are disposed corresponding to the nozzles 111 respectively.

The flow path spacer substrate 12 and the pressure chamber substrate 13 are each a plate-like member whose shape viewed in the Z direction is substantially the same as the nozzle substrate 11.

The flow path spacer substrate 12 in this embodiment is made of a silicon substrate. The thickness of the flow path spacer substrate 12 is not particularly limited, but is several hundreds of μm. The nozzle substrate 11 is attached (fixed) to the upper surface of the flow path spacer substrate 12, and the pressure chamber substrate 13 to the lower surface 13, both with an adhesive agent.

The material of the pressure chamber substrate 13 is a ceramic piezoelectric body (a member that deforms in response to voltage application). PZT (lead zirconate titanate), lithium niobate, barium titanate, lead titanate, lead metaniobate, etc. are examples of the piezoelectric body. PZT is used for the pressure chamber substrate 13 in this embodiment.

The penetrating flow paths 121 of the flow path spacer substrate 12 are through holes penetrating the flow path spacer substrate 12 in the Z direction, whose cross-section perpendicular to the Z direction is in a rectangular shape longer in the Y direction. The pressure chambers 131 of the pressure chamber substrate 13 are through holes penetrating the pressure chamber substrate 13 in the Z direction, and have a cross section perpendicular to the Z direction in a shape identical to that of the penetrating flow paths 121. In the state where the flow path spacer substrate 12 and the pressure chamber substrate 13 are joined, the penetrating flow paths 121 and the pressure chambers 131 are connected to form channels 141 (ink storages). The channels 141 are disposed at positions overlapping the nozzles 111 and communicate to the nozzles 111. Ink is supplied via the ink supply openings 151 on the wiring substrate 15 and is stored in each of the channels 141.

Figure 5:
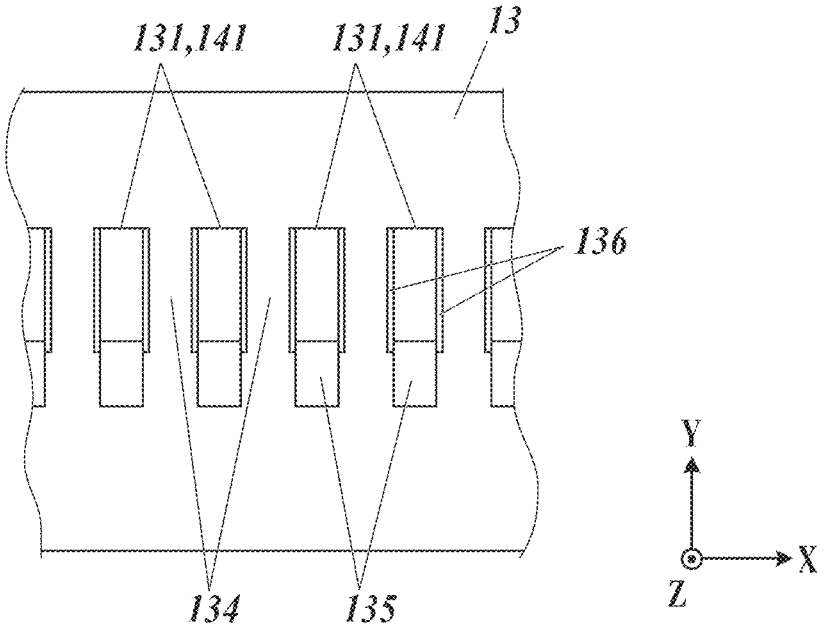
FIG. 5 is an enlarged plan view of a lower surface of a pressure chamber substrate.

FIG. 5 is an enlarged plan view of the lower surface of the pressure chamber substrate 13. As shown in FIG. 5, each of the pressure chambers 131 is partitioned from the pressure chambers 131 next to each other in the X direction by the partitions 134 of a piezoelectric body. A metal drive electrode 136 (pressure changer) is disposed on each of the inner walls of the partitions 134 of the pressure chambers 131.

Connection electrodes 135 electrically connected to the drive electrodes 136 are disposed in an area near the openings of the pressure chambers 131 on the −Y direction side on the surface of the pressure chamber substrate 13. The connection electrodes 135 are electrically connected to an external drive circuit via the wiring 153 of the wiring substrate 15 and the wiring 21 of the FPC 20 shown in FIG. 4.

In the pressure chamber substrate 13, as the partitions 134 repeat shear mode displacement according to the drive signals applied to the drive electrodes 136 via the connection electrodes 135, pressures in ink in the pressure chambers 131 (channels 141, accordingly) change. The changes in pressure causes ink in the channels 141 to be discharged from the nozzles 111. Thus, the head chip 10 of this embodiment is a head chip that discharges ink in the shear mode.

An air chamber without an ink flow-in path may be disposed instead of the channel 141 alternately at a position of every other channel 141 in the X direction in FIGS. 4 and 5. Such a configuration can prevent deformation of the partition 134 next to the pressure chamber 131 in the channel 141 from affecting the other channels 141.

As shown in FIG. 4, the flow path spacer substrate 12 extends in the arrangement direction of the channels 141 (X direction), and includes the first belt-like penetrating path 123*a* and the second belt-like penetrating flow path 123*b* penetrating the flow path spacer substrate 12 in the Z direction. The first belt-like penetrating flow path 123*a* is disposed on the +Y direction side of the row of the channels 141, and the second belt-like penetrating flow path 123*b* is disposed on the −Y direction side of the row of the channels 141. The first ditch-like flow path 132*a* is disposed in an area overlapping the first belt-like penetrating flow path 123*a* in the Z direction on the joint face of the pressure chamber substrate 13 with the flow path spacer substrate 12. The second ditch-like flow path 132*b* is disposed in an area overlapping the second belt-like penetrating flow path 123*b* in the Z direction.

The first belt-like penetrating flow path 123*a* and the first ditch-like flow path 132*a* form the first common ejection flow path 142*a* extending in the X direction in the state where the flow path spacer substrate 12 and the pressure chamber substrate 13 are joined. The first belt-like penetrating flow path 123*b* and the second ditch-like flow path 132*b* form the second common ejection flow path 142*b* extending in the X direction in the state where the flow path spacer substrate 12 and the pressure chamber substrate 13 are joined. The first common ejection flow path 142*a* and the second common ejection flow path 142*b* configured as described above extend along the joint face of the flow path spacer substrate 12 and the nozzle substrate 11 (that is, the joint face of the flow path substrate 14 and the nozzle substrate 11), and part of the inner wall thereof is formed of the nozzle substrate 11. Hereinafter, the first common ejection flow path 142*a* and the second common ejection flow path 142*b* when indistinct are simply referred to as the common ejection flow path(s) 142.

The first vertical ejection flow path 133*a* penetrating the pressure chamber substrate 13 in the Z direction is connected to the end in the +X direction of the first common ejection flow path 142*a*. The second vertical ejection flow path 133*b* penetrating the pressure chamber substrate 13 in the Z direction is connected to the end in the X direction of the second common ejection flow path 142*b*. Hereinafter, the first vertical ejection flow path 133*a* and the second vertical ejection flow path 133*b* when indistinct are simply referred to as the vertical ejection flow path(s) 133.

As described above, in the flow path spacer substrate 12, the first individual ejection flow paths 122*a* connected to the first belt-like penetrating flow path 123*a* (first common ejection flow path 142*a*) and the second individual ejection flow paths 122*b* connected to the second belt-like penetrating flow path 123*b* (second common ejection flow path 142*b*) are branched from each of the penetrating flow paths 121 (channels 141). The first individual ejection flow paths 122*a* are each a ditch-like flow path extending in the +Y direction from an opening of the penetrating flow path 121 on the nozzle substrate 11 side along the surface of the flow path spacer substrate 12, and part of the inner wall thereof is formed of the nozzle substrate 11. The second individual ejection flow paths 122*b* are each a ditch-like flow path extending in the −Y direction from an opening of the penetrating flow path 121 on the nozzle substrate 11 side along the surface of the flow path spacer substrate 12, and part of the inner wall thereof is formed of the nozzle substrate 11. That is, the first individual ejection flow paths 122*a* and the second individual ejection flow paths 122*b* extend in the opposite directions from the penetrating flow paths 121 (channels 141). Hereinafter, the first individual ejection flow path 122*a* and the second individual ejection flow path 122*b* when indistinct are simply referred to as the individual ejection flow path(s) 122.

Figure 6:
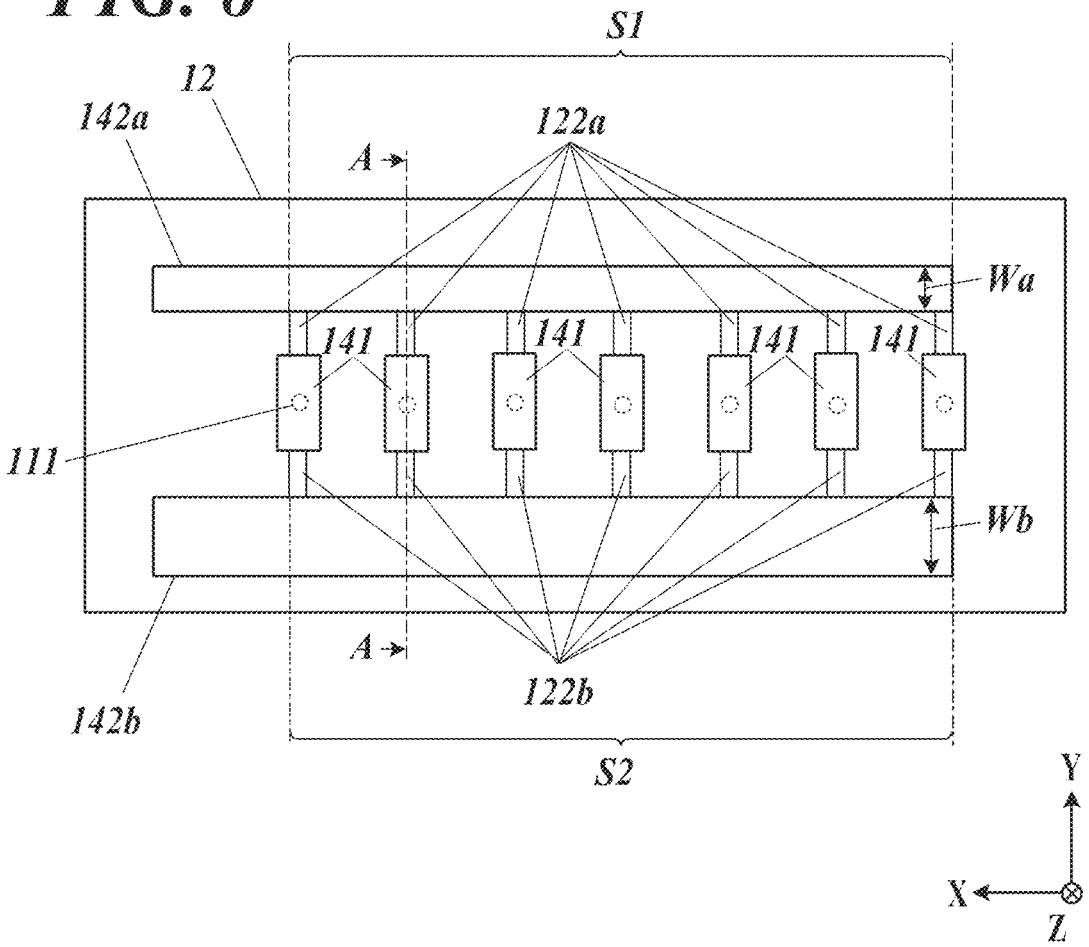
FIG. 6 is a plan view of an upper surface of a flow path spacer substrate.

FIG. 6 is a plan view of the upper surface of the flow path spacer substrate 12.

Figure 7:
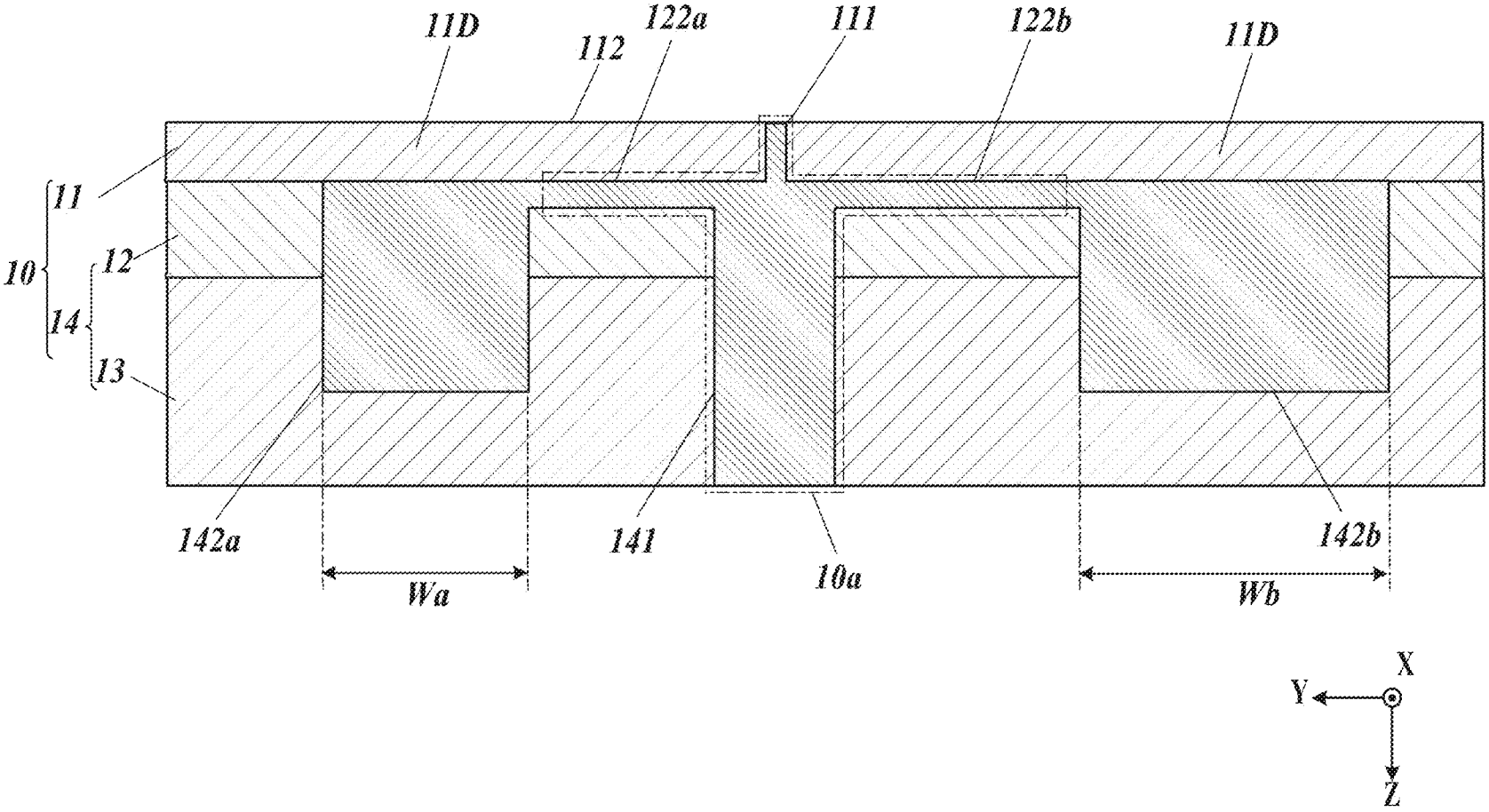
FIG. 7 shows a cross-section of ahead chip perpendicular to an X direction along a line A-A in FIGS. 4 and 6.

FIG. 7 shows a cross-section of the head chip 10 perpendicular to the X direction along a line A-A in FIGS. 4 and 6.

Hereinafter, a section of the first common ejection flow path 142*a* into which ink flows from the first individual ejection flow paths 122*a* is the first section S1, and a section of the second common ejection flow path 142*b* into which ink flows from the second individual ejection flow path 122*b* is the second section S2. Specifically, the first section S1 is a section between the most upstream connection point and the most downstream connection point in the ink ejection direction (X direction) of the connection points of the first individual ejection flow paths 122*a* to the first common ejection flow path 142*a*. The second section S2 is a section between the most upstream connection point and the most downstream connection point in the ink ejection direction (X direction) of the connection points of the second individual ejection flow paths 122*b* to the second common ejection flow path 142*a*.

In this embodiment, the length in the X direction and the depth in the Z direction are equal between the first section S1 and the second section S2.

However, the width Wa of the first section S1 in the Y direction is smaller than the width Wb of the second section in the Y direction. Thus, as shown in FIG. 7, the rectangular area (first area) of the cross-section perpendicular to the X direction (direction of ink ejection) in the first section S1 in the first common ejection flow path 142*a* is smaller than the rectangular area (second area) of the cross-section perpendicular to the X direction in the second section S2 in the second common ejection flow path 142*a*. More specifically, the length of the side parallel to the Z direction is equal between the rectangle of the first cross-section and the rectangle of the second cross-section, but the length of the side parallel to the Y direction is smaller in the rectangle of the first cross-section. As a result, the volume of the first common ejection flow path 142*a* in the first section S1 is smaller than that of the second common ejection flow path 142*b* in the second section S2.

The effects and advantages of differentiation of the shapes and volumes between the first common ejection flow path 142*a* and the second common ejection flow path 142*b* are described in detail later.

As shown in FIG. 7, a part of the nozzle substrate 11 that forms the inner wall of the common ejection flow path 142 functions as a damper plate 11D with flexibility.

As a pressure wave caused by a change in the pressure in ink in the channel 141 propagates to the common ejection flow path 142 via the individual ejection flow path 122, a change in the pressure in ink may be caused inside the common ejection flow path 142. As the damper plate 11D deforms (bends) according to the change in the pressure in ink in the common ejection flow path 142 in that case, the pressure change may be absorbed.

The opposite side of the damper plate 11D from the common ejection flow path 142 is open air, and air does not prevent the damper plate 11D from deforming with the elasticity. Thus, the change in the pressure in ink inside the common ejection flow path 142 may be effectively absorbed.

The channel 141, the first individual ejection flow path 122*a*, the second individual ejection flow path 122*b*, and the nozzle 111 shown in FIG. 7 and the drive electrode 136 as a pressure changer shown in FIG. 5 form an ink discharger 10*a*. Thus, the head chip 10 includes as many ink discharger 10*a* as the nozzles 111.

In the head chip 10 configured as described above, part of ink supplied to the channel 141 and not discharged from the nozzle 111 is ejected to the outside via the first individual ejection flow path 122*a* and the first common ejection flow path 142*a*, and via the second individual ejection flow path 122*b* and the second common ejection flow path 142*b*. Specifically, ink having passed through the first individual ejection flow path 122*a* and the first common ejection flow path 142*a* is ejected to the outside of the inkjet head 100 through the outlet 103*b* (or the outlet 103*c*) via the first vertical ejection flow path 133*a* and the first ejection hole 152*a* disposed on the wiring substrate 15. Similarly, ink having passed through the second individual ejection flow path 122*b* and the second common ejection flow path 142*b* is ejected to the outside of the inkjet head 100 through the outlet 103*b* (or the outlet 103*c*) via the second vertical ejection flow path 133*b* and the second ejection hole 152*b* disposed on the wiring substrate 15. The first common ejection flow path 142*a* and the second common ejection flow path 142*b* may communicate to a common outlet, or respectively to individual outlets.

Such a configuration as described above makes it possible to eject air bubbles and foreign substances that have entered the channels 141 may be ejected outside with ink.

Flow of ink supplied through the ink supply holes 151 to the channels 141 and flow of ink ejected from the channels 141 through the first common ejection flow path 142*a* or the second common ejection flow path 142*b* may be generated by an ink circulation mechanism 9 (see FIG. 8) of the inkjet recording apparatus 1.

The wiring substrate 15 shown in FIG. 4 is preferably a plate-like substrate with an area larger than that of the pressure chamber substrate 13 for securing the connecting region with the pressure chamber substrate 13, and is attached to the lower surface of the pressure chamber 13 with an adhesive agent. Glass, ceramics, silicone, plastics, and the like may be used for the wiring substrate 15, for example.

The wiring substrate 15 includes multiple ink supply openings 151 at positions overlapping the channels 141 in the Z direction, and the first ejection outlet 152*a* and the second ejection outlet 152*b* at positions overlapping the first vertical ejection flow path 133*a* and the second vertical ejection flow path 133*b*. Hereinafter, the first ejection outlet 152*a* and the second ejection outlet 152*b* when indistinct are simply referred to as the ejection outlet(s) 152. Wires 153 extending from each of ends of the ink supply openings 151 toward the end of the wiring substrate 15 are provided on the face of the wiring substrate 15 attached to the pressure chamber substrate 13.

An ink manifold (common ink chamber) not shown in the drawings is connected to the lower face of the wiring substrate 15, and ink is supplied from the ink manifold to the ink supply openings 151.

The pressure chamber substrate 13 and the wiring substrate 15 are attached by a conductive adhesive agent including conductive particles. Thus, the connection electrodes 135 on the pressure chamber substrate 13 and the wires 153 on the wiring substrate 15 are electrically connected via the conductive particles.

The FPC 20 is connected to the end of the wiring substrate 15 with wires 153 via an ACF (anisotropic conductive film), for example. The wires 153 on the wiring substrate 15 are electrically connected respectively to the wires 21 on the FPC 20 by this connection.

Next, a configuration of an ink circulation mechanism 9 for circulating and ejecting ink in the inkjet head 100 is described.

Figure 8:
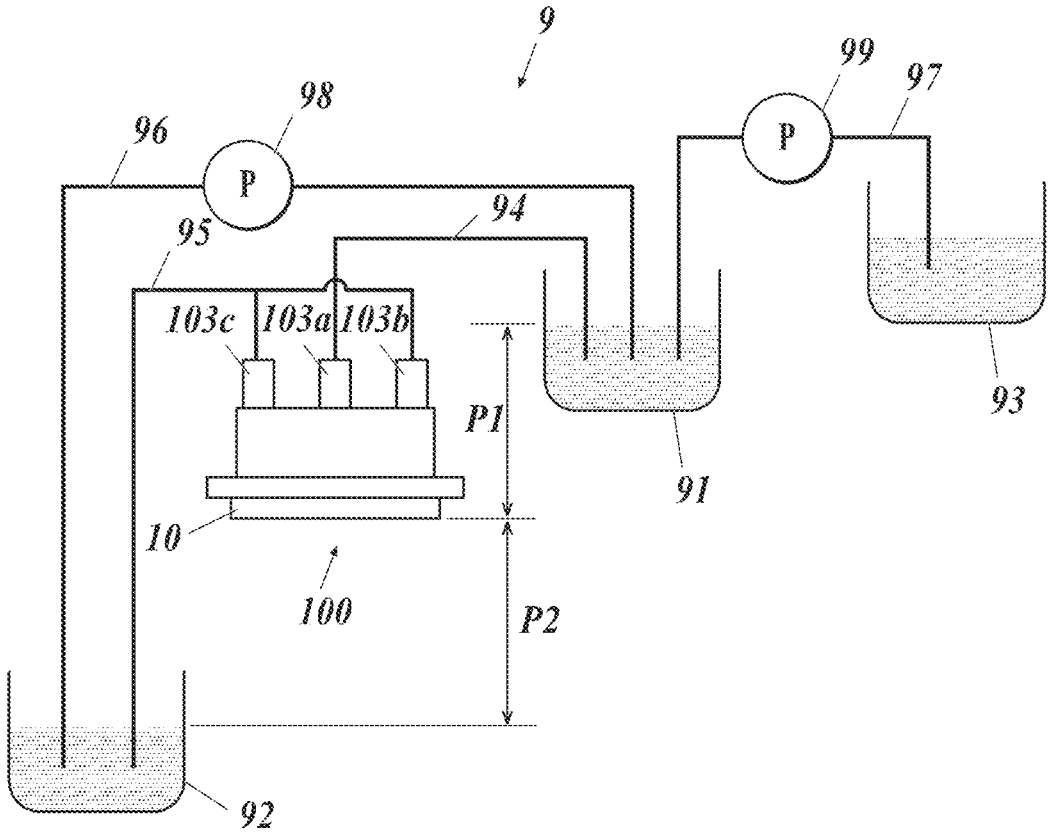
FIG. 8 schematically shows a configuration of an ink circulation mechanism.

FIG. 8 schematically shows a configuration of the ink circulation mechanism 9.

The ink circulation mechanism 9 includes a supply subtank 91, reflux subtank 92, and a main tank 93.

The supply subtank 91 stores ink supplied to the ink manifold in the inkjet head 100. The supply subtank 91 is connected to the inlet 103*a* with an ink flow path 94.

The reflux subtank 92 is connected to the outlets 103*b* and 103*c* with an ink flow path 95, and stores ink passing through the above-described ink ejection flow path including the individual ejection flow paths 122 and the common ink ejection flow paths 142 and ejected to the outlet 103*b* or the outlet 103*c*.

The supply subtank 91 and the reflux subtank 92 are connected via the ink flow path 96. Ink may be returned from the reflux subtank 92 to the supply subtank 91 by a pump 98 provided on the ink flow path 96.

The main tank 93 stores ink supplied to the supply subtank 91. The main tank 93 is connected to the supply subtank 91 with the ink flow path 97. Ink is supplied from the main tank 93 to the supply subtank 91 by the pump 99 provided on the ink flow path 97.

The liquid level of the supply subtank 91 is provided at a position higher than the ink discharge level of the head chip 10 (hereinafter also referred to as a "position reference level"), and the liquid level of the reflux subtank 92 is provided at a position lower than the position reference level. A pressure P1 caused by a water head difference between the position reference level and the supply subtank 91 and a pressure P2 caused by a water head difference between the position reference level and the reflux subtank 92 are generated. As a result, a pressure in ink at the inlet 103*a* is higher than pressures in ink at the outlets 103*b*, 103*c*. The difference in pressure generates ink flow from the inlet 103*a* through the ink manifold, the ink supply openings 151, the channels 141, the penetrating flow paths 121, the individual ejection flow paths 122, the common ejection flow paths 142, the vertical ejection flow paths 133, the ejection holes 152 to the outlets 103*b* and 103*c*, and ink is supplied to the ink discharger 10*a* and ejected (refluxed) from the ink discharger 10*a*. The pressure P1 and the pressure P2 may be adjusted and the ink flow speed may be thereby adjusted, as the amounts of ink in the subtanks and the positions of the subtanks in the vertical direction are changed.

Next, functions and effects of the above-described configuration of the first common ejection flow path 142*a* and the second common ejection flow path 142*b* are described.

As described above, the change in the pressure in ink in the common ejection flow path 142 caused by the pressure wave propagating from the channels 141 to the common ejection flow path 142 is absorbed as part of the nozzle substrate 11 functions as the damper plate 11D. However, it is difficult that the change in the pressure in ink in the common ejection flow path 142 is completely absorbed by the damper plate 11D.

The pressure change that is not absorbed causes a standing wave in the common ejection flow path 142. The standing wave is generated by interference of pressure waves propagating from the multiple channels 141 inside the common ejection flow path 142, and the characteristics (wavelength, period, amplitude, phase, etc.) are influenced by the shape of the common ejection flow path 142 (especially the shapes of the above-described first section S1 and second section S2).

As the pressure wave caused by the standing wave inside the common ejection flow path 142 propagates to the channels 141 via the individual ejection flow path 1122, the ink pressure in the channel 141 deviates from the desired pressure in ink discharge. As a result, a fluctuation in the characteristics of ink discharge from the nozzle 111 (crosstalk) is generated, resulting in deterioration of the image quality of recorded images.

Especially, in a conventional configuration with two common ejection flow paths 142 in the same shape, the pressure waves caused by the standing waves in the two common ejection flow paths 142 are superposed and increased in the channels 141, and thereby the deterioration of the image quality due to crosstalk is significant, problematically.

Figure 9:
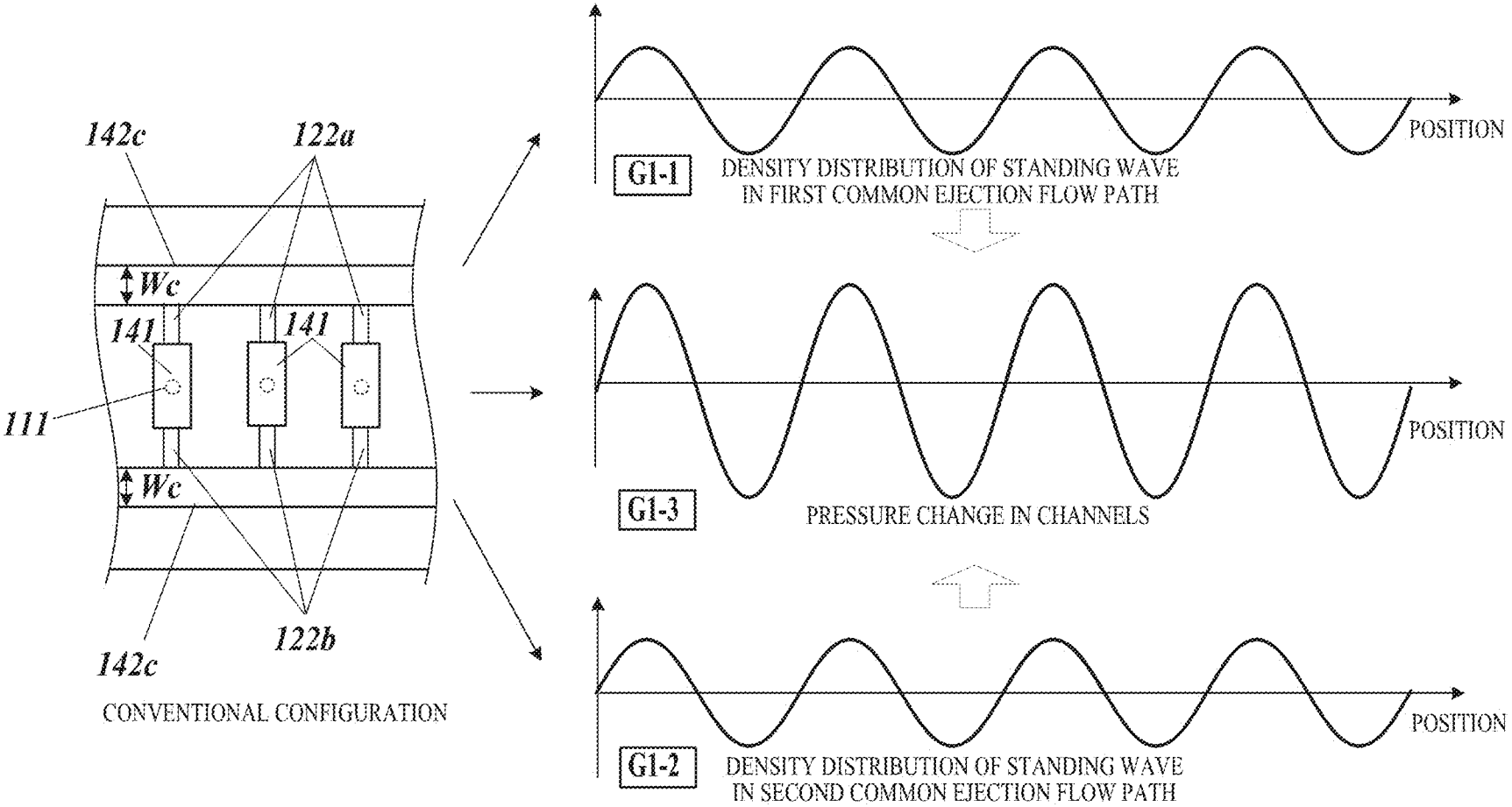
FIG. 9 is a diagram for describing problems in a conventional configuration.

FIG. 9 is a diagram for describing problems in a conventional configuration.

As shown on the left of FIG. 9, in a conventional configuration, two common ejection flow paths 142*c* having the same shape and an equal width (Wc) are provided on the upper and lower sides of the channels 141. In such a conventional configuration, the positions and shapes of the two common ejection flow paths 142*c* are symmetrical to the channels 141. Thus, a standing wave with almost the same characteristics is generated in each of the common ejection flow paths 142*c*, because of the pressure waves propagating from the channels 141 to the common ejection flow paths 142*c*.

A graph G1-1 on the upper right of FIG. 9 shows a density distribution (pressure distribution) in the X direction of standing waves generated in the (first) common ejection flow path 142*c* on the upper side. A graph G1-2 on the lower right of FIG. 9 shows a density distribution (pressure distribution) in the X direction of standing waves generated in the (second) common ejection flow path 142*c* on the lower side. As can be seen in these graphs, the standing waves generated in the two common ejection flow paths 142*c* have the almost same characteristics (wavelength, period, amplitude, and phase).

A graph G1-3 in the center right of FIG. 9 shows a magnitude of the pressure change caused by the pressure waves propagating from the two common ejection flow paths 142*c* in the channels 141 throughout in the X direction. That is, the graph G1-3 shows a magnitude of the influence of the standing waves generated in the two common ejection flow paths 142*c* to the channels 141. As shown in the graph G1-3, the distribution of the pressure change in the channels 141 has a profile of superposed density distributions of the standing waves in the two common ejection flow paths 142*c*. That is, in the conventional configuration in FIG. 9, as the phases of the standing waves of the two common ejection flow paths 142*c* are aligned, the pressure change in the channels 141 is superimposed pressures with the same phases of the standing waves in the two common ejection flow paths 142*c*. As a result, the fluctuation of the ink discharge characteristics (crosstalk) is increased, resulting in significant deterioration of the image quality.

On contrary, in the inkjet head 100 in this embodiment, the characteristics of the standing waves in the common ejection flow paths 142 do not correspond to each other, as the shape of the first section S1 of the first common ejection flow path 142*a* and the shape of the second section S2 of the second common ejection flow path 142*b* are different from each other.

Figure 10:
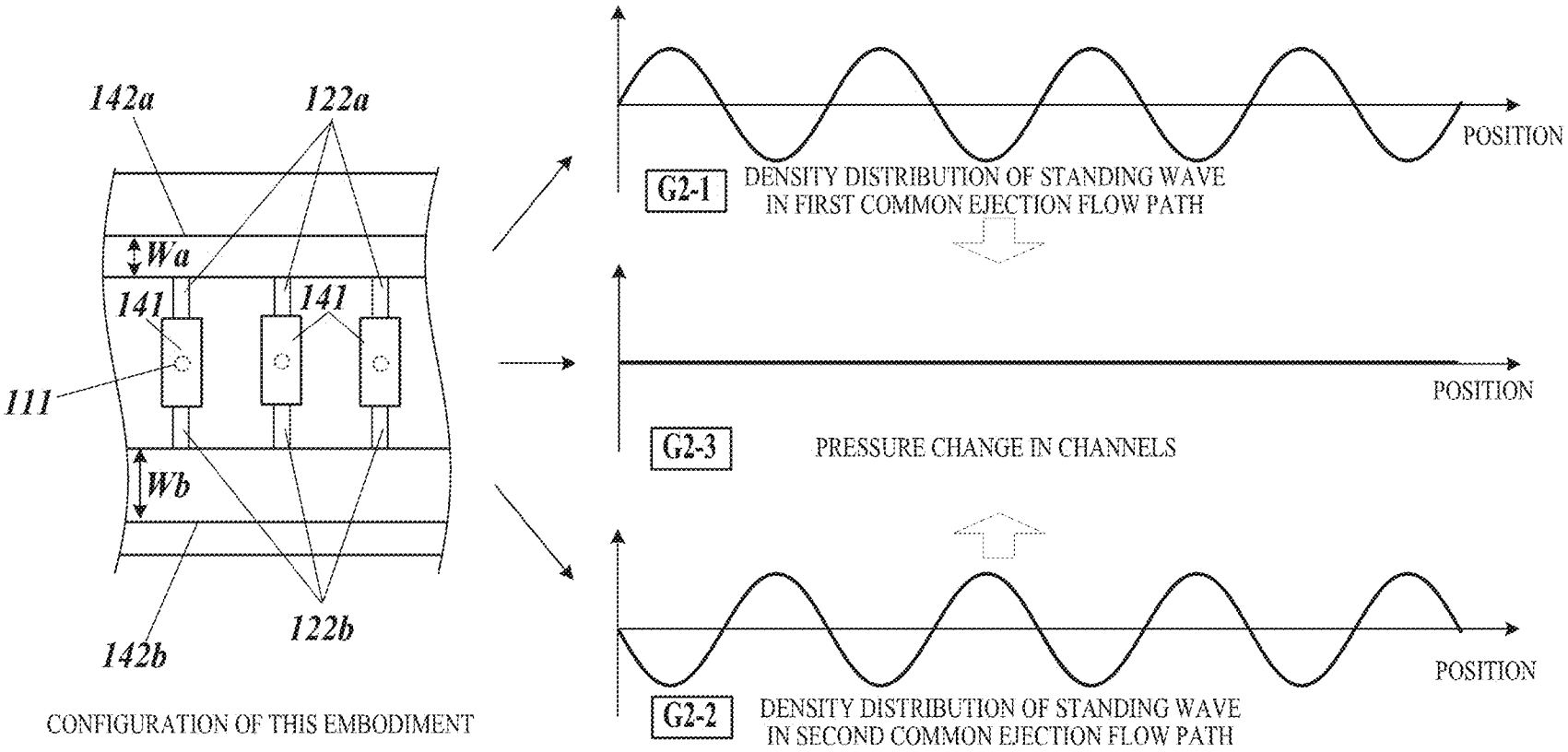
FIG. 10 is a diagram for describing effects to be expected in a configuration of this embodiment.

FIG. 10 is a diagram for describing effects to be expected in a configuration in this embodiment.

A graph G2-1 on the upper right of FIG. 10 shows a density distribution (pressure distribution) of standing waves generated in the first section S1 of the first common ejection flow path 142*a* of this embodiment. A graph G2-2 on the lower right shows a density distribution of standing waves generated in the second section S2 of the second common ejection flow path 142*b*. As can be seen in these graphs, in this embodiment, as the shapes of the first section S1 and the second section S2 are different from each other, the phases of the standing waves generated in the first section S1 and the second section S2 are misaligned by 180 degrees.

As a result, as shown in the graph G2-3 on the center right of FIG. 10, the pressure changes in the channels 141 caused by the standing waves are zero, as the pressures of the opposite phases in the first common ejection flow path 142*a* and the second common ejection flow path 142*b* are set off against each other. That is, the standing waves do not affect the channels 141 at any positions. As a result, the fluctuation of the ink discharge characteristics (crosstalk) caused by the standing waves in the common ejection flow paths 142 is suppressed to be extremely low, and thus the deterioration of the image quality due to the standing waves is effectively suppressed.

Figure 11:
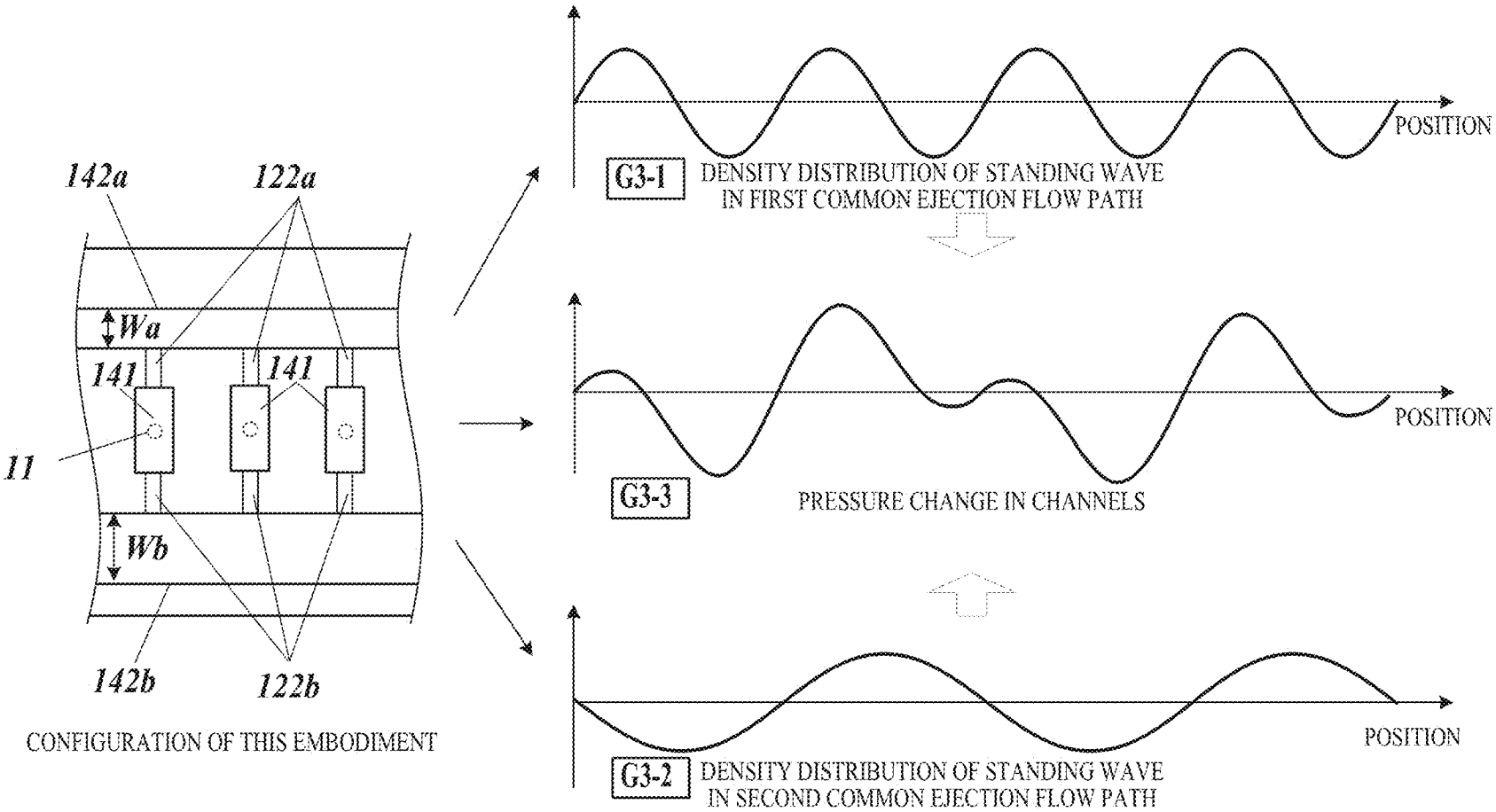
FIG. 11 is a diagram for describing effects to be expected in another configuration of this embodiment.

FIG. 11 is a diagram for describing effects to be expected in another configuration of this embodiment.

As the shapes of the first section S1 and the second section S2 are adjusted, the wavelength of the standing wave generated in the second section S2 may be twice the wavelength of the standing wave created in the first section S1, as shown in the graph G3-2 on the lower right of FIG. 11. In that case, the influence of the standing waves generated in the two common ejection flow paths 142 is not completely canceled, but the pressure change of the standing waves (compression and rarefaction) at many positions. Thus, the pressure change caused by the standing waves in the channels 141 is suppressed compared to the conventional configuration shown in FIG. 9, as shown in the graph G3-3 on the center right of FIG. 11.

As the shapes of the first section S1 and the second section S2 are adjusted, at least any of the wavelength, amplitude, period, and phase may be differentiated between the standing wave generated in the first section S1 and the standing wave generated in the first section S1, in a way different from those in FIGS. 10 and 11. For example, the phase of the standing waves in the first section S1 and the second section S2 are shifted at 180 degrees in the example shown in FIG. 10, but the phase difference of the standing wave may be other than 180 degrees. The wavelength ratio of the first section S1 to the second section S2 is two in the example shown in FIG. 11, but the wavelength ratio may be other than two.

In many cases among those, the influence of the standing waves in the two common ejection flow paths 142 is not completely set off, but it is possible to suppress the fluctuation of the ink discharge characteristics (crosstalk) in the channels 141 by canceling part of the influence of the standing waves. This makes it possible to suppress the deterioration of the image quality caused by the standing waves.

Next, an experiment for checking the effects of the above-described embodiment is described.

In the experiment, samples of 19 types of inkjet heads 100, "No. 1" to "No. 19," which have different combinations of shapes of the first section S1 in the first common ejection flow path 142*a* and the second section S2 in the second common ejection flow path 142*b* were prepared, and the extent of crosstalk in each of the samples was evaluated.

Specifically, prepared as the samples were inkjet heads 100 each including: 256 channel 141 (nozzles 111) to each of which the first individual ejection flow path 122*a* and the second individual ejection flow path 122*b* communicate; the first common ejection flow path 142*a* to which the 256 first individual ejection flow paths 122*a* are connected; and the second common ejection flow path 142*b* to which the 256 second individual ejection flow paths 122*b* are connected. Hereinafter, regarding the size of the first section S1 in the first common ejection flow path 142*a* in each sample, the length in the X direction is referred to as a "length La," the width in the Y direction a "width Wa," the depth in the Z direction a "depth Da," and the volume a "volume Va." Regarding the size of the second section S2 in the second common ejection flow path 142*b* in each sample, the length in the X direction is referred to as a "length Lb," the width in the Y direction a "width Wb," the depth in the Z direction a "depth Db," and the volume a "volume Vb."

FIG. 12 shows shapes of the samples used in the experiment and evaluation results.

Shown in FIG. 12 are the sizes of the first section S1 and the second section S2, the ratios of the sizes (size ratios) of the second section S2 to the first section S1, and evaluation results about the crosstalk, in the samples in 19 types.

The sample "No. 1," in which the shape of the first section S1 in the first common ejection flow path 142*a* and the shape of the second section S2 in the second common ejection flow path 142*b* were identical, was a comparative example. In the sample "No. 1," the lengths La and Lb were 72 mm, the widths Wa and Wb 1 mm, the depths Da and Db 1 mm, and the volumes Va and Vb 72 $mm^3$.

In the samples "No. 2" to "No. 7," the depth Db of the second section S2 in the second common ejection flow path 142*b* was increased compared to the sample "No. 1." Specifically, in the samples "No. 2" to "No. 7," the depths Db were, respectively, 1.05 mm, 1.1 mm, 1.2 mm, 1.3 mm, 1.4 mm, and 1.5 mm.

In the samples "No. 8" to "No. 13," the width Wb of the second section S2 in the second common ejection flow path 142*b* was increased compared to the sample "No. 1." Specifically, in the samples "No. 8" to "No. 13," the widths Wb were, respectively, 1.05 mm, 1.1 mm, 1.2 mm, 1.3 mm, 1.4 mm, and 1.5 mm.

In the samples "No. 14" to "No. 19," both the width Wb and the depth Db of the second section S2 in the second common ejection flow path 142*b* were increased compared to the sample "No. 1." Specifically, in the samples "No. 14" to "No. 19," both the widths Wb and the depths Db were, respectively, 1.05 mm, 1.1 mm, 1.2 mm, 1.3 mm, 1.4 mm, and 1.5 mm.

The crosstalk was evaluated on two levels of "good" and "poor."

Specifically, the 256 channels 141 were driven in two types of drive patterns at drive frequencies of 10 Hz and 10 kHz, the crosstalk was evaluated based on the maximum rate of change in the ink flight speed (maximum change rate) in the channel 141 among all the 256 channels 141. Specifically, the samples with the maximum change rate of the flight speed less than 10% were evaluated as "good," and those with the rate equal to or greater than 10% were evaluated as "poor." "Good" indicates that the level of the crosstalk is in a normal range for obtaining the image quality without problems in actual use, and "poor" indicates that the level of the crosstalk is problematically out of an allowable range of deterioration in the image quality.

The evaluation result of the crosstalk "poor" was obtained in the samples "No. 1," "No. 2," and "No. 8," in which the volume ratio of the second section S2 to the first section S1 (Vb/Va) is 1.05 or less, and the evaluation result "good" was obtained in the other samples in which the volume ratio (Vb/Va) is 1.1 or greater, as shown in FIG. 12. That is, it was confirmed that, with a configuration in which the volume of the second section S2 in the second common ejection flow path 142*b* is 1.1 times the volume of the first section S1 of the first common ejection flow path 142*a*, it is possible to suppress the crosstalk caused by the standing waves in the common ejection flow paths 142 and obtain the image quality without problems in actual use.

However, as the volume of the second section S2 was over 10 times the volume of the first section S1, ink was ejected from the channels 141 mainly to the common ejection flow path 142*b*, and with difficulty to the first common ejection flow path 142*b*. Thus, the volume ratio between the first section S1 and the second section S2 is preferably not over 10.

As described hereinbefore, the inkjet head 100 in this embodiment includes: the ink dischargers 10*a*, each including: the channel 141 as an ink storage for storing ink; the drive electrode 136 as a pressure changer that changes pressure in ink stored in the channel 141; the nozzle 111 which communicates to the channel 141 and through which ink is discharged according to change in the pressure in ink in the channel 141; and the first individual ejection flow path 122*a* and the second individual ejection flow path 122*b* which communicate to the channel 141 and through which ink is ejected from the channel 141 but not supplied to the nozzle 111; the first common ejection flow path 142*a* that communicates to the first individual ejection flow paths 122*a* of the respective ink dischargers 10*a*; and the second common ejection flow path 142*b* that communicates to the second individual ejection flow paths 10*b* of the respective ink dischargers 10*a*; wherein the shape of the first section S1 of the first common ejection flow path 142*a* into which ink flows from the first individual ejection flow paths 122*a* is different from the shape of the second section S2 of the second common ejection flow path 122*b* into which ink flows from the second individual ejection flow paths 142*b*.

With such a configuration, the characteristics of the standing waves generated in the first section S2 and the second section S2 (wavelength, period, amplitude, phase, etc.) may be different from each other. This makes it possible to set off at least part of the pressure wave caused by the standing waves propagating from the two common ejection flow paths 142 to the channels 141. Therefore, it is possible to suppress the pressure change in the channels 141 caused by propagation of the pressure wave caused by the standing waves to the channels 141, and thus suppress the fluctuation of the ink discharge characteristics (crosstalk) in the channels 141. As a result of the above, the deterioration of the image quality due to the standing waves may be effectively suppressed.

As ink is ejected from the channels 141 via the two common ejection flow paths 142, bubbles and foreign substances in the channels 141 may be effectively ejected, in comparison to a configuration with a single common ejection flow path 142.

As the volume of the first section S1 of the first common ejection flow path 142*a* is different from the volume of the second section S2 of the second common ejection flow path. 142*b*, it is is possible to more effectively differentiate the characteristics of the standing waves generated in the first section S1 and the second section S2.

As the volume of the second section S2 of the second common ejection flow path 142*b* is 1.1 times or more the volume of the first section S1 of the first common ejection flow path 142*a*, it is possible to effectively differentiate the characteristics of the standing waves generated in the first section S1 and the second section S2, and suppress the extent of crosstalk to be in a range that can obtain the image quality without problems in actual use.

In the first section S1 of the first common ejection flow path 142*a*, a cross section perpendicular to the X direction (the direction of ink ejection) has a rectangular shape with the first area throughout in the X direction, and in the second section S2 of the second common ejection flow path 142*b*, a cross section perpendicular to the X direction (the direction of ink ejection) is a rectangular shape with the second area throughout in the X direction. The second area is 1.1 times or more the first area. With such a configuration, it is possible to effectively differentiate the characteristics of the standing waves generated in the first section S1 and the second section S2 by simply differentiating the lengths of the sides of the rectangular cross sections of the first section S1 and the second section S2.

As the volume of the second section S2 of the second common ejection flow path 142*b* is 10 times or less the volume of the first section S1 of the first common ejection flow path 142*a*, it is is possible to suppress occurrence of errors in which ink is not smoothly ejected from the channels 141 to the first common ejection flow path 142*a*.

The inkjet head 100 in this embodiment includes the outlet 103*b* and the outlet 103*c* as an ink ejection opening through which ink is ejected outside, and the first common ejection flow path 142*a* and the second common ejection flow path 142*b* communicate to the outlet 103*b* or the outlet 103*c*. This makes it possible to eject outside air bubbles and foreign substances in the channels 141.

As the inkjet recording apparatus 1 in this embodiment includes the above-described inkjet head 100, it is possible to form high-quality images with suppressed crosstalk.

Next, Variations 1 to 5 of the above-described embodiment are described. Each variation may be combined with other variations.

(Variation 1)

Figure 13:
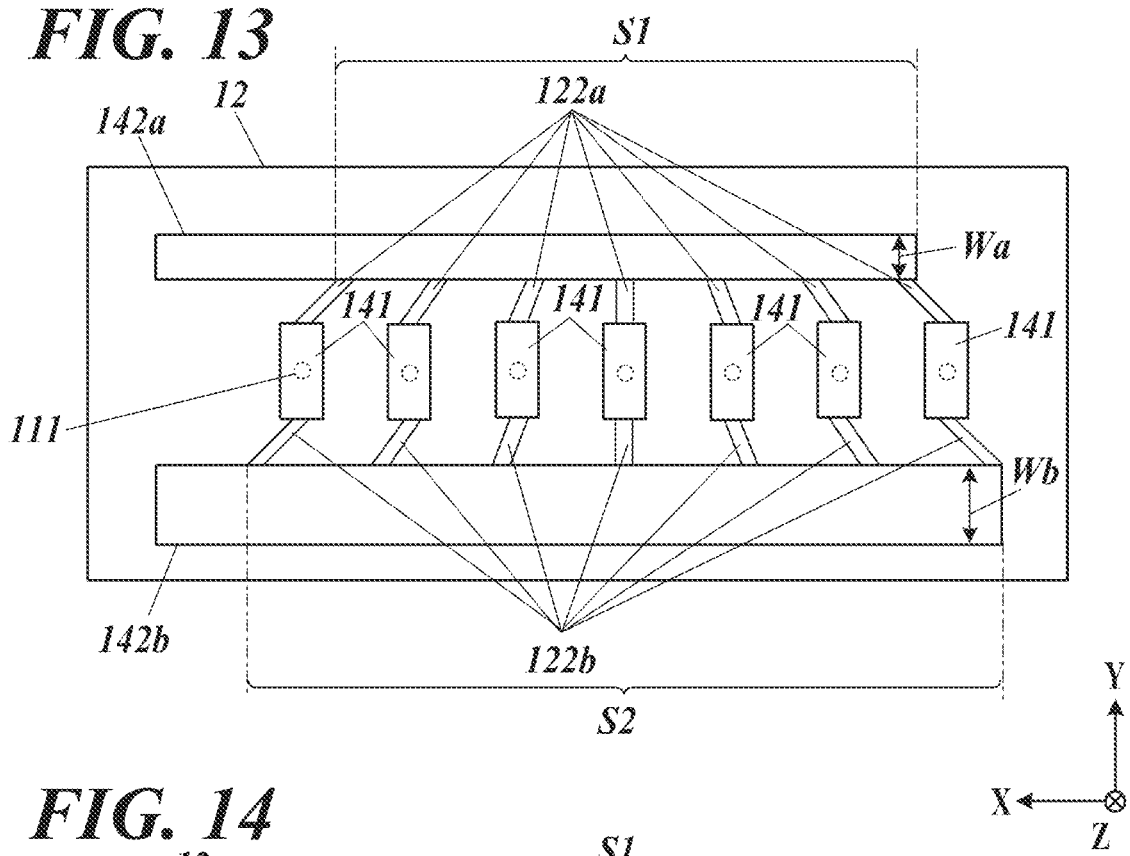
FIG. 13 is a plan view of an upper surface of the flow path spacer substrate in Variation 1.

FIG. 13 is a plan view of an upper surface of the flow path spacer substrate 12 in Variation 1.

This variation is different from the above-described embodiment in that the first section S1 of the first common ejection flow path 142*a* and the second section S2 of the second common ejection flow path 142*b* are different from each other in length in the X direction, and is the same as the above-described embodiment in other respects.

As shown in FIG. 13, in this variation, the first individual ejection flow path 122*a* and the second individual ejection flow path 122*b* branched from each of the channels 141 extend in respective directions that are inclined in mutually opposite directions from the Y direction. Because of this, the length in the X direction (direction of ink ejection) of the first section S1 of the first common ejection flow path 142*a* to which ink flows from the first individual ejection flow paths 122 is shorter than the length in the X direction of the second section S2 of the second common ejection flow path 142*b* to which ink flows from the second individual ejection flow paths 142*b*.

With the configuration in which the length of the first section S1 along the ink ejection direction in the first section S1 is different from the length of the second section S2 along the ink ejection direction in the second section S2, the characteristics of the standing waves in the section S1 and the section S2 may be different from each other.

(Variation 2)

In the variation 2, the shape of the first section S1 of the first common ejection flow path 142*a* is different from the shape of the second section S2 of the second ejection flow path 142*b*, and in addition, the surface roughness of the inner wall of the first section S1 is different from the surface roughness of the inner wall of the second section S2. Variation 2 is the same as the above-described embodiment in other respects.

In this variation, the surface roughness Ra of the inner wall of the first section S1 (arithmetic average of roughness) is greater than the surface roughness Ra of the inner wall of the second section S2. With this configuration, in the first section S1 of the first common ejection flow path 142*a* with a surface roughness Ra comparatively large, the pressure wave entering from the individual ejection flow path 122 is more easily absorbed with the unevenness of the surface of the inner wall. This makes it possible to effectively differentiate the characteristics of the standing waves generated in the first section S1 and the second section S2.

The surface roughness Ra of part of the inner wall of the first section S1 may be greater than the surface roughness Ra of corresponding part of the inner wall of the second section S2. For example, the surface roughness Ra may be different between the first section S1 and the second section S2 in the part formed by the nozzle substrate 11 only, and the surface roughness Ra may be the same in the rest of the inner wall.

The inequality relation of the surface roughness Ra may be inverse in the first section S1 and the second section S2. That is, the surface roughness Ra (arithmetic average of roughness) of the inner wall of the first section S1 may be smaller than the surface roughness Ra of the inner wall of the second section S1.

(Variation 3)

Figure 14:
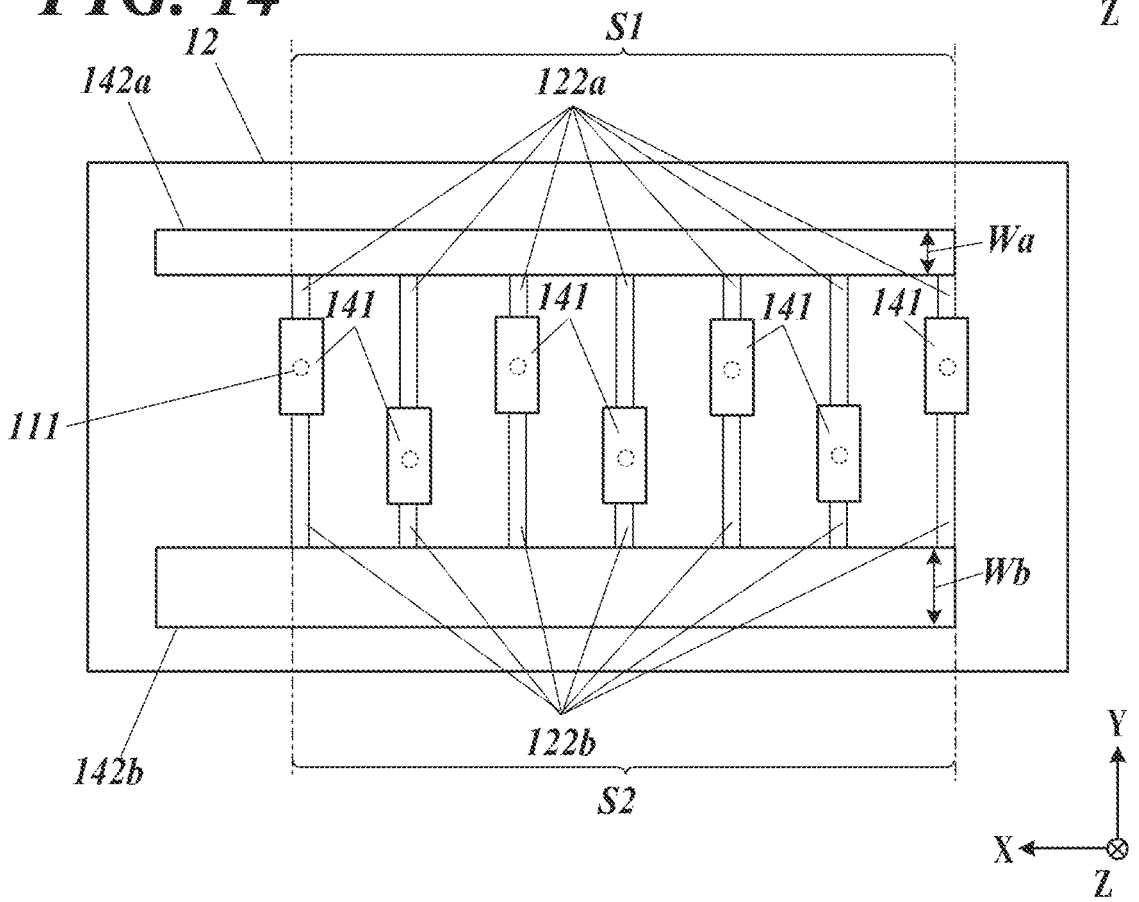
FIG. 14 is a plan view of an upper surface of the flow path spacer substrate in Variation 3.

FIG. 14 is a plan view of an upper surface of the flow path spacer substrate 12 in Variation 3.

This variation is different from the above-described embodiment in that the first individual ejection flow paths 122*a* and the second individual ejection flow paths 122*b* branching from the channels 141 are different from each other in length, and is the same as the above-described embodiment in other respects.

As shown in FIG. 14, the channels 141 are arranged in a staggered pattern. That is, the channels 141 are arranged in two rows (channel rows) in the X direction, and the positions of the two channel rows are misaligned in the X direction so as to differentiate the positions of the channels 141.

With this configuration, in the channels 141 odd-numbered in the X direction, the length in the Y direction (direction of ink ejection) of the first individual ejection flow paths 122*a* is shorter than that of the second individual ejection flow paths 122*b*. On contrary, in the channels 141 even-numbered in the X direction, the length in the Y direction of the first individual ejection flow paths 122*a* is longer than that of the second individual ejection flow paths 122*b*.

With the configuration in which the length in the direction of ink ejection of the first individual ejection flow path 122*a* communicating to one of the channels 141 is different from the length in the direction of ink ejection of the second individual ejection flow path 122*b* communicating to the concerning one of the channels 141 as in this variation, the characteristics of the pressure wave propagating from the channels 141 to the common ejection flow path 142*a* are different from the characteristics of the pressure wave propagating from the channels 141 to the second common ejection flow path 142*b*. This makes it possible to effectively differentiate the characteristics of the standing waves generated in the first common ejection flow path 142*a* and the second common ejection flow path 142*b*.

(Variation 4)

Figure 15:
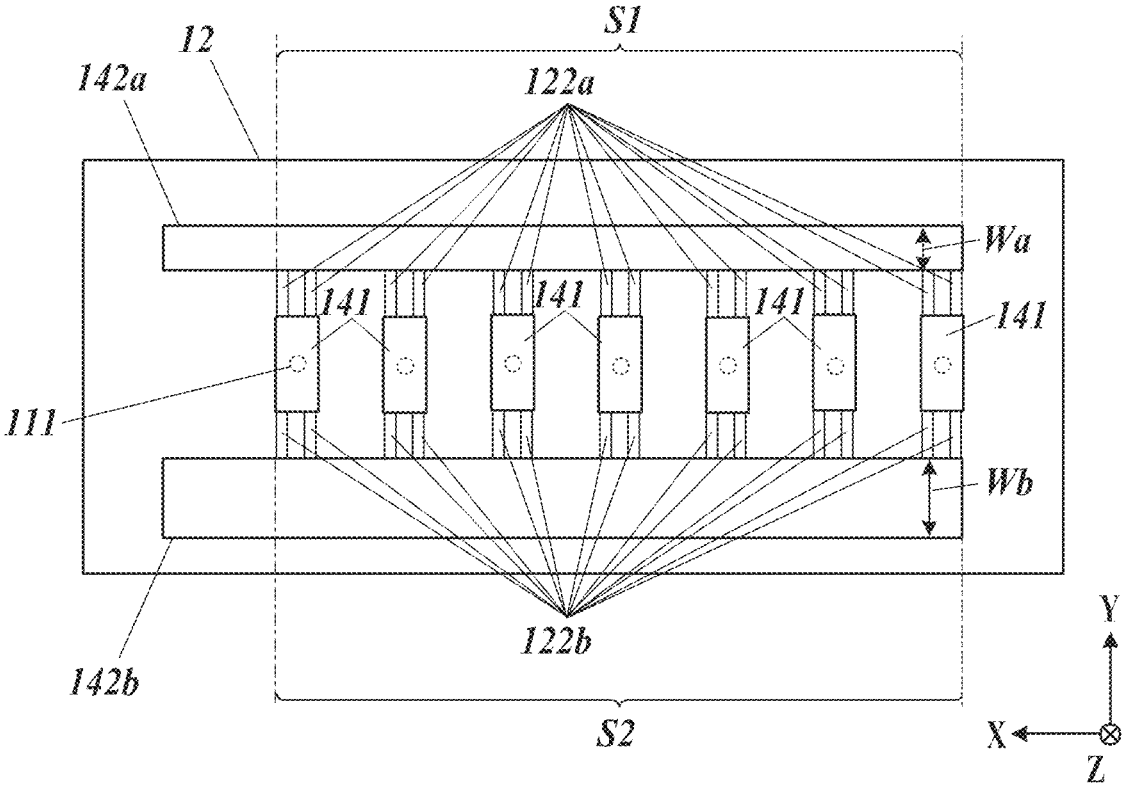
FIG. 15 is a plan view of an upper surface of the flow path spacer substrate in Variation 4.

FIG. 15 is a plan view of an upper surface of the flow path spacer substrate 12 in Variation 4.

This variation is different from the above-described embodiment in that two of the first individual ejection flow paths 122*a* and two of the second individual ejection flow paths 122*b* communicate to each of the channels 141, and is the same as the above-described embodiment in other respects.

As shown in FIG. 15, each of the channels 141 and the first common ejection flow path 142*a* are connected by two of the first individual ejection flow paths 122*a*, and each of the channels 141 and the second common ejection flow path 142*b* are connected by two of the second individual ejection flow paths 122*b*. In FIG. 15, the two of the first individual ejection flow paths 122*a* connected to one of the channels 141 are equal in length and width, and so are the two second individual ejection flow paths 122*b*. However, the configuration is not limited to the above, and two of the first common individual ejection flow paths 122*a* communicating to one of the channels 141 may be different from each other in width and length, and two of the second individual ejection flow paths communicating to one of the channels 141 may be different from each other in length and width.

The number of the first individual ejection flow paths 122*a* and the second individual ejection flow paths 122*b* communicating to each of the channels 141 may be three or more.

With the configuration in which two or more of the first individual ejection flow paths 122*a* and two or more of the second individual ejection flow paths 122*b* communicate to one of the channels 141, it is possible to effectively eject air bubbles and foreign substances from the channels 141.

(Variation 5)

Figure 16:
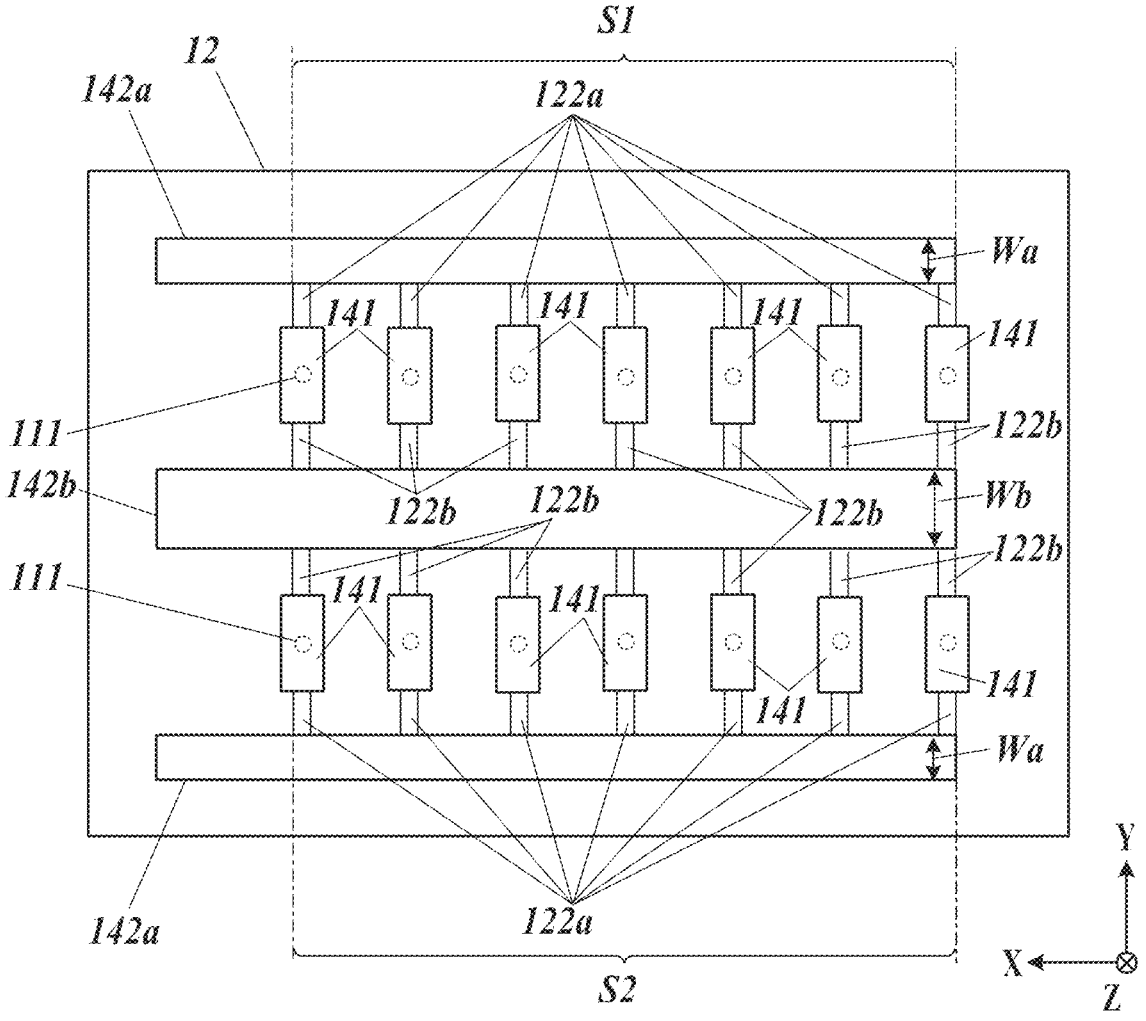
FIG. 16 is a plan view of an upper surface of the flow path spacer substrate in Variation 5.

FIG. 16 is a plan view of an upper surface of the flow path spacer substrate 12 in Variation 5.

In this variation, the channels 141 are aligned in two rows (channel rows) in the X direction, and the first common ejection flow path 142*a* and the second common ejection flow path 142*b* are arranged on the both sides of the channels 141. The second ejection flow path 142*b* is shared by the two channel rows.

In other words, the first common ejection flow path 142*a*, the second common ejection flow path 142*b*, and the first common ejection flow path 142*a* parallel to one another are arranged in the said order in the Y direction, and one channel row is aligned in the X direction between the second common ejection flow path 142 and one of the first common ejection flow paths 142*a*, and another channel row is aligned in the X direction between the second common ejection flow path 142 and the other one of the first common ejection flow paths 142*a*. The channels 141 in each channel row communicate to the first common ejection flow path 142*a* and the second common ejection flow path 142*b* on each side in the Y direction.

With the configuration in this variation, more ink flows into the second common ejection flow path 142*b* as the channels 141 twice as many in number as those connected to the first common ejection flow path 142*a* are connected thereto, but as the width Wb of the second common ejection flow path 142*b* is greater than the first common ejection flow path 142*b*, it is possible to suppress occurrence of troubles of congestion of ink flow to the second common ejection flow path 142*b*. The characteristics of the standing waves generated in the two first common ejection flow paths 141*a* may be different from the characteristics of the standing waves generated in the second common ejection flow path 142*b*.

The present invention is not limited to the above embodiment and variations, and various changes can be made thereto.

For example, in the above embodiment and variations, the full widths, depths, and lengths of the first section S1 and the second section S2 are differentiated so that the shapes of the first section S1 in the first common ejection flow path 142*a* and the second section S2 in the second common ejection flow path 142*b* are different from each other. However, the invention is not limited to this. The first section S1 and the second section S2 may be in any shape under the condition that one does not coincide with the other even if rotated or moved in any way.

For example, the widths and depths of the first section S1 and the second section S2 may be changed by position. Alternatively, the cross-sectional areas of the first section S1 and the second section S2 may be gradually increased in the direction of ink ejection in the common ejection flow paths 142. The first section S1 and the second section S2 may be different in shape but equal in volume.

The common ejection flow paths 142 and the individual ejection flow paths 122 are not necessarily in a linear shape, and may be in a shape bended at a point midway.

Ink is not necessarily ejected in the same direction in the first common ejection flow path 142*a* and the second common ejection flow path 142*b*, and ink may be ejected in the opposite directions.

In the above embodiment and variations, part of the nozzle substrate 11 functions as the damper substrate 11D, as an example. However, the present invention is not limited to this. For example, a sealed air chamber may be provided inside the head chip 10, and the common ejection flow path 142 is provided at a position adjacent to the air chamber. A material between the common ejection flow path 142 and the air chamber may thereby function as a damper substrate.

The configuration may be without a damper substrate.

In the above embodiment, the common ejection flow path 142 includes the belt-like penetrating flow path 123 in the flow path spacer substrate 12 and the ditch-like flow path 132 in the pressure substrate 13, as an example. However, the present invention is not limited to this. For example, the common ejection flow path 142 may be a ditch on the surface of the spacer substrate 12 on the nozzle substrate 11 side.

The head chip 10 may be with the pressure chamber substrate 13 and the nozzle substrate 11 but without the flow path spacer substrate 12. In that case, the flow path substrate 14 is composed exclusively by the pressure chamber substrate 13, and the individual ejection flow paths 122 and the common ejection flow paths 142 are provided in the pressure chamber substrate 13. In that case, the individual ejection flow path 122 and the common ejection flow path 142 may be a ditch provided on the surface of the pressure chamber substrate 13 on the nozzle substrate 11 side.

In the above-described embodiment, the inkjet head 100 including the head chip 10 in the shear mode is described as an example. However, the present invention is not limited to this. For example, the present invention may be applied to an inkjet head with a head chip in a bent mode in which ink in the pressure chamber is changed by deforming a pressure element (pressure changer) fixed on the wall of the pressure chamber as the ink storage.

In the above-described embodiment and variations, the recording medium M is conveyed by the conveyor 2 with the conveyance belt 2*c*, as an example. However, the present invention is not limited to this, and the conveyor 2 may convey the recording medium M by holding the recording medium M on the peripheral surface of the rotating conveyance drum, for example.

In the above-described embodiment and variations, the inkjet recording apparatus 1 in a single pass format is described as an example, but the present invention can be applied to the inkjet recording apparatus which records the image while scanning with the inkjet heads 100.

While the present invention is described with some embodiments, the scope of the present invention is not limited to the above-described embodiments but encompasses the scope of the invention recited in the claims and the equivalent thereof.

INDUSTRIAL APPLICABILITY

The present invention can be used in an inkjet head and an inkjet recording apparatus.

REFERENCE SIGN LIST

1 Inkjet Recording Apparatus
2 Conveyor
2*a*, 2*b* Conveying Roller
2*c* Conveyance Belt
3 Head Unit
9 Ink Circulation Mechanism
10 Head Chip
10*a* Ink Discharger
11 Nozzle Substrate
11D Damper Plate
111 Nozzle
112 Nozzle Opening Face
12 Flow Path Spacer Substrate
121 Penetrating Flow Path
122*a* First Individual Ejection Flow Path
122*b* Second Individual Ejection Flow Path
123*a* First Belt-like Penetrating Flow Path
123*b* Second Belt-like Penetrating Flow Path
13 Pressure Chamber Substrate
131 Pressure Chamber
132*a* First Ditch-like Flow Path
132*b* Second Ditch-like Flow Path
133*a* First Vertical Ejection Flow Path
133*b* Second Vertical Ejection Flow Path
134 Partition
135 Connection Electrode
136 Drive Electrode
14 Flow Path Substrate
141 Channel
142*a* First Common Ejection Flow Path
142*b* Second Common Ejection Flow Path
142*c* Common Ejection Flow Path
15 Wiring Substrate
151 Ink Supply Opening
152*a* First Ejection Hole
152*b* Second Ejection Hole
20 FPC
100 Inkjet Head
103*a* Inlet
103*b*, 103*c* Outlet
M Recording Medium
S1 First Section
S2 Second Section

What is claimed is:

1. An inkjet head comprising:
a plurality of ink dischargers, each comprising:
an ink storage for storing ink;
a pressure changer that changes pressure in ink stored in the ink storage;
a nozzle which communicates to the ink storage and through which ink is discharged according to change in the pressure in ink in the ink storage; and
a first individual ejection flow path and a second individual ejection flow path which communicate to the ink storage and through which ink is ejected from the ink storage but not supplied to the nozzle;
a first common ejection flow path that communicates to a plurality of first individual ejection flow paths of the respective plurality of the ink dischargers; and
a second common ejection flow path that communicates to a plurality of second individual ejection flow paths of the respective plurality of the ink dischargers;
wherein a shape of a first section of the first common ejection flow path into which ink flows from the plurality of first individual ejection flow paths is different from a shape of a second section of the second common ejection flow path into which ink flows from the plurality of second individual ejection flow paths.

2. The inkjet head according to claim 1, wherein a volume of the first section of the first common ejection flow path is different from a volume of the second section of the second common ejection flow path.

3. The inkjet head according to claim 2, wherein the volume of the second section of the second common ejection flow path is 1.1 times or more the volume of the first section of the first common ejection flow path.

4. The inkjet head according to claim 3,
wherein in the first section of the first common ejection flow path, a cross section perpendicular to a direction of ink ejection has a rectangular shape with a first area throughout in the direction of ink ejection;

wherein in the second section of the second common ejection flow path, a cross section perpendicular to a direction of ink ejection is a rectangular shape with a second area throughout in the direction of ink ejection; and wherein the second area is 1.1 times or more the first area.

5. The inkjet head according to claim 2, wherein the volume of the second section of the second common ejection flow path is 10 times or less the volume of the first section of the first common ejection flow path.

6. The inkjet head according to claim 1, wherein a length of the first section in a direction of ink ejection in the first section is different from a length of the second section in a direction of ink ejection in the second section.

7. The inkjet head according to claim 1, wherein a surface roughness of an inner wall of the first section of the first common ejection flow path is different from a surface roughness of an inner wall of the second section of the second common ejection flow path.

8. The inkjet head according to claim 1, wherein a length of the first individual ejection flow path communicating to the ink storage in a direction of ink ejection in the first individual ejection flow path is different from a length of the second individual ejection flow path communicating to the ink storage in a direction of ink ejection in the second individual ejection flow path.

9. The inkjet head according to claim 1, wherein the first individual ejection flow path communicating to the ink storage comprises two or more first individual ejection flow paths, and the second individual ejection flow path communicating to the ink storage comprises two or more second individual flow paths.

10. The inkjet head according to claim 1, comprising:

an ink ejection opening through which ink is ejected outside, wherein the first common ejection flow path and the second common ejection flow path communicate to the ink ejection opening.

11. An inkjet recording apparatus comprising the inkjet head according to claim 1.

* * * * *